United States Patent [19]

Sakai et al.

[11] Patent Number: 5,011,764

[45] Date of Patent: Apr. 30, 1991

[54] SILVER HALIDE COLOR PHOTOGRAPHIC MATERIAL WHICH FORMS A COLOR PHOTOGRAPHIC IMAGE WITH IMPROVED PRESERVABILITY

[75] Inventors: Nobuo Sakai; Minoru Sakai, both of Kanagawa, Japan

[73] Assignee: Fuji Photo Film Co., Ltd., Kanagawa, Japan

[21] Appl. No.: 178,937

[22] Filed: Apr. 7, 1988

[30] Foreign Application Priority Data

Apr. 7, 1987 [JP] Japan ..... 62-85449

[51] Int. Cl.[5] ..... G03C 1/46; G03C 1/38

[52] U.S. Cl. ..... 430/505; 430/512; 430/546; 430/551; 430/553; 430/613; 430/614

[58] Field of Search ..... 430/505, 512, 546, 551, 430/553, 613, 614, 512, 546, 551, 553, 613, 614

[56] References Cited

U.S. PATENT DOCUMENTS

| | | | |
|---|---|---|---|
| 3,615,613 | 10/1971 | Shiba et al. | 430/614 |
| 4,199,363 | 4/1980 | Chen | 430/512 |
| 4,596,767 | 6/1986 | Mihara et al. | 430/576 |
| 4,622,287 | 11/1986 | Umemoto et al. | 430/505 |
| 4,668,611 | 5/1987 | Nakamura | 430/507 |
| 4,686,177 | 8/1987 | Aoki et al. | 430/553 |
| 4,801,521 | 1/1989 | Ohki et al. | 430/380 |
| 4,820,614 | 4/1989 | Takada et al. | 430/505 |
| 4,857,449 | 8/1989 | Ogawa et al. | 430/546 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide color photographic material comprising a support having thereon at least one red-sensitive silver halide emulsion layer, at least one green-sensitive silver halide emulsion layer and at least one blue-sensitive silver halide emulsion layer, where the red-sensitive halide emulsion layer contains a dispersion of oleophilic fine particles which is obtained by emulsifying or dispersing a solution containing at least one cyan coupler represented by the general formula (I) and at least one water-insoluble and organic solvent-soluble homopolymer or copolymer, the green-sensitive silver halide emulsion layer contains at least one magenta coupler represented the general formula (II) or (III), the blue-sensitive silver halide emulsion layer contains at least one yellow coupler represented by the general formula (IV), and the silver halide color photographic material contains at least one compound represented by the general formula (B):

(I)

(II)

(III)

(IV)

(B)

Moieties are defined in the specification. The multilayer silver halide color photographic material of the present invention is good in color forming property, improved in image preservability, and free from adverse changes in color balance, as well as having high sensitivity and exhibiting less change in sensitivity with the lapse of time.

26 Claims, No Drawings

SILVER HALIDE COLOR PHOTOGRAPHIC MATERIAL WHICH FORMS A COLOR PHOTOGRAPHIC IMAGE WITH IMPROVED PRESERVABILITY

FIELD OF THE INVENTION

The present invention relates to a multilayer silver halide color -photographic material, and, more particularly, to a multilayer silver halide color photographic material which is good in color forming property, improved in preservability of images and particularly free from any harm to color balance as well as which has high sensitivity and exhibits less change in sensitivity with the lapse of time.

BACKGROUND OF THE INVENTION

In order to form color photographic images, it is well known that an exposed -photographic light-sensitive material having light-sensitive layers containing photographic couplers for the three colors, yellow, magenta and cyan, respectively, is subjected to color development processing using a color developing agent. In this processing, a colored dye is formed upon a coupling reaction of a coupler with an oxidation product of an aromatic primary amine. It is preferred that the couplers have a coupling rate which is as fast as possible so as to provide high color density within a short developing time.

On the other hand, the color photographic images formed are required to show good preservability under various conditions. In order to satisfy this requirement, it is of importance that dyes formed with different hues show a slow color fading or discoloring rate and that the dyes show a discoloring rate as uniformly as possible over the total image density region so as to not make the color balance of the remaining dye image unbalanced.

With conventional light-sensitive materials, particularly color papers, cyan dye images are seriously deteriorated by long-time dark fading due to the influence of humidity and heat and, hence, they are liable to undergo changes in their color balance, and there is a strong desire in the art to improve this fault Cyan dyes with good dark fading resistance, conventionally, show poor hue and are liable to fade and disappear under light. Thus a novel combination of couplers has been demanded, because there has been a fairly marked reciprocal tendency therebetween.

In order to partly solve this problem, there have so far been proposed specific combinations of various couplers Some examples are given in, for example, Japanese Patent Publication No. 7344/77, Japanese Patent Application (OPI) Nos. 200037/82, 57238/84, 160143/84 and 205446/85 (the term "OPI" as used herein means an "unexamined published application). However, these combinations still fail to totally remove all disadvantages in that only insufficient color forming properties are obtained; the dyes formed have so poor a hue that color reproduction is adversely affected; the color balance of the final dye image is changed due to deterioration by, particularly, heat or light; and the cyan hue temporarily disappears under light.

Recently, demands on silver halide photographic materials have become much stricter in the art. For example, with respect to color paper, it has been strongly desired to get high sensitivity in order to reduce the time for printing and to achieve uniformity, that is, to minimize differences in sensitivity due to change of properties with the lapse of time or differences in sensitivity between lots of color paper to increase the yield of useful prints.

Various investigations have been made in order to increase the spectral sensitivity of -photographic light-sensitive materials. For instance, the art has searched for sensitizing dyes having good spectral sensitizing efficiency. Also, supersensitization has been attempted. Specifically, a method for increasing the spectral sensitizing efficiency by a combination of some kinds of specific sensitizing dyes and methods using a combination of specific compounds and sensitizing dyes are as described in T.H. James, *The Theory of the Photographic Process*, Fourth Edition, pages 259 to 265, Macmillan Co., N.Y.

Further, as is well known in the art, there is another method for increasing spectral sensitivity where the inherent sensitivity of silver halide per se is increased by means of, for example, using silver halide grains of large size or appropriately selecting the method of chemical sensitization. However, although these methods are effective as far as an increase in spectral sensitivity is concerned, they are accompanied with some adverse effects on other -photographic properties, for example, a severe increase in fog, a deterioration in preservability, and an increase in remaining color due to sensitizing dyes. Thus they are still insufficient for practical purposes.

With silver halide color -photographic materials, it has been desired to develop a technique which can simultaneously overcome the degradation problems with cyan dye images due to the influence of light, heat and humidity with no reciprocal tendency among the degradation problems remaining, in order to achieve good preservability of color photographic images formed under various conditions. Techniques which partially address these problems result in various disadvantages in color forming property, the color hue of dyes formed, sensitivity and uniformity, etc., as discussed above, and thus there is today no practical means to solve the above problems Accordingly, it has become very important to provide a means to totally solve the above problems.

SUMMARY OF THE INVENTION

Therefore, an object of the present invention is to provide a multilayer silver halide color photographic material which has good color forming property and forms a color photographic image with improved preservability (as used herein, "preservability" means resistance to light, heat and humidity as mentioned above) particularly with no change in color balance when the same is stored in a dark place or exposed to light for a long period of time, and in addition, which has high sensitivity and which exhibits less change in sensitivity with the lapse of time.

Other objects of the present invention will become apparent from the following discussion.

As a result of various investigations on couplers and dispersing techniques for such couplers, it was found that a multilayer silver halide color photographic material which is good in color forming property, improved in image preservability, and free from harmful changes in color balance for an extended period of time can be obtained by using a solution containing a specific cyan coupler(s) and a water-insoluble and organic solvent-soluble homopolymer or copolymer and by using a specific magenta coupler(s) and cyan coupler(s) in a combination.

As a result of further investigations on further improvements of the sensitivity and the stability of sensitivity with the lapse of time in any red-sensitive emulsion layer(s), it was found that unexpected and superior results are obtained by incorporating a compound which is known as a brightening agent into the photographic light-sensitive material, thus resulting in the completion of the present invention.

More specifically, the above described objects of the present invention can be achieved with a silver halide color photographic material comprising a support having thereon at least one red-sensitive silver halide emulsion layer, at least one green-sensitive silver halide emulsion layer and at least one blue-sensitive silver halide emulsion layer, where the red-sensitive halide emulsion layer contains a dispersion of oleophilic fine particles which is obtained by emulsifying or dispersing a solution containing at least one cyan coupler represented by the general formula (I) later given and at least one water-insoluble and organic solvent-soluble homopolymer or copolymer, the green-sensitive silver halide emulsion layer contains at least one magenta coupler represented by general formula (II) or (III) later given, the blue-sensitive silver halide emulsion layer contains at least one yellow coupler represented by the general formula (IV) later given, and the silver halide color photographic material contains at least one compound represented by general formula (B) later given.

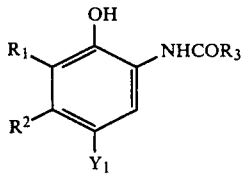

(I)

where $R_1$ represents a hydrogen atom or a halogen atom; $R_2$ represents a alkyl group; $R_3$ represents a ballast group; and $Y_1$ represents a hydrogen atom or a group released at the time of coupling reaction with an oxidation product of a developing agent (hereafter simply referred to as a releasing group),

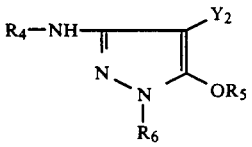

(II)

where $R_4$ represents an aryl group; $R_5$ represents a hydrogen atom, an aliphatic or aromatic acyl group or an aliphatic or aromatic sulfonyl group; $R_6$ represents an aryl group; and $Y_2$ represents a hydrogen atom or a releasing group,

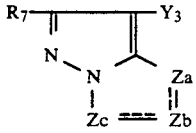

(III)

where $R_7$ represents a hydrogen atom or a substituent; $Y_3$ represents a hydrogen atom or a releasing group; Za, Zb and Zc each represents a methine group, a substituted methine group, =N—or —NH—, one of the Za—Zb bond and the Zb—Zc bond being a double bond and the other being a single bond; when the Zb—Zc bond is a carbon carbon double bond, the Zb—Zc bond may be a part of a condensed aromatic ring; $R_7$ or $Y_3$ may also form a polymer including a dimer or more; and when Za, Zb or Zc is a substituted methine group, the substituted methine group may form a polymer including a dimer or more,

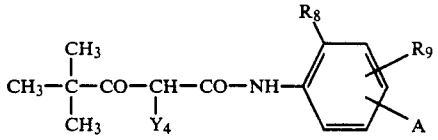

(IV)

where $R_8$ represents a halogen atom or an alkoxy group; $R_9$ represents a hydrogen atom, a halogen atom or an alkoxy group; A represents $—NHCOR_{10}$, $—NHSO_2R_{10}$, $—SO_2NHR_{10}$, $—COOR_{10}$ or $$—SO_2N(R_{11})—R_{10}$$

(wherein $R_{10}$ and $R_{11}$ each represents an alkyl group); and $Y_4$ represents a hydrogen atom or a releasing agent,

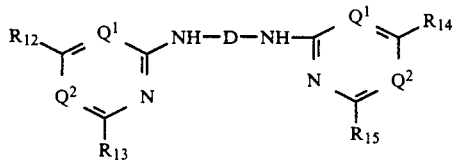

(B)

where D represents a divalent aromatic group; $R_{12}$, $R_{13}$, $R_{14}$ and $R_{15}$, which may be the same or different, each represents a hydrogen atom, a hydroxy group, an alkoxy group, an aryloxy group, a halogen atom, a heterocyclic group, a mercapto group, an alkylthio group, an arylthio group, a heterocyclic thio group, an amino group, an alkylamino group, a cyclohexylamino group, an arylamino group, a heterocyclic amino group, an aralkylamino group or an aryl group; and $Q^1$ and $Q^2$ each represents —N=or —CH=and at least one of $Q^1$ and $Q^2$ is —N=.

DETAILED DESCRIPTION OF THE INVENTION

In the following, the polymers which can be employed in the present invention are described in detail.

The polymer which can be employed in the present invention may be any polymer and which is water-insoluble and organic solvent-soluble. As a degree of water-insolubility of the polymers which can be employed in the present invention, it is preferred that up to 3 g of the polymers is dissolved in 100 g of distilled water, and it is more preferred that up to 1 g of the polymer is dissolved in 100 g of distilled water.

Of the polymers those composed of a repeating unit having a linkage of

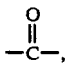

particularly a repeating unit having a group of

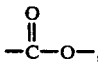

in the main chain or side chain are preferred in view of color forming property and the effect on preventing color fading. Also, polymers composed of a repeating unit having a group of

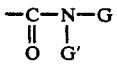

(wherein G and G' each represents a hydrogen atom, an alkyl group or an aryl group) in the side chain are preferred.

The polymers which can be used in the present invention are explained in more detail with reference to specific examples thereof, but the present invention should not be construed as being limited to these polymers.

(A) Vinyl polymers

Monomers for forming a vinyl polymer used in the present invention include an acrylic acid ester, a methacrylic acid ester, a vinyl ester, an acrylamide, a methacrylamide, an olefin, a styrene, a vinyl ether and other vinyl monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy) acrylate, 2-(2-butoxyethoxy)ethyl acrylate, ω-methoxypolyethylene glycol acrylate (the number of ethyleneoxide therein is 9), 1-bromo-2-methoxyethyl acrylate, 1,1-di-chloro-2-ethoxyethyl acrylate, etc.

Specific examples of methacrylic acid esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N—ethyl—N—phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (the number of ethyleneoxide therein is 6), allyl methacrylate, dimethylaminoethyl methacrylate methyl chloride salt, etc.

Specific examples of vinyl esters include vinyl acetate, vinyl propionate, vinyl butyrate, vinyl isobutylate, vinyl caproate, vinyl chloroacetate, vinyl methoxyacetate, vinyl phenylacetate, vinyl benzoate, vinyl salicylate, etc.

Specific examples of acrylamides include acrylamide, methylacrylamide, ethylacrylamide, propylacrylamide, butylacrylamide, tert-butylacrylamide, cyclohexylacrylamide, benzylacrylamide, hylroxymethylacrylamide, methoxyethylacrylamide, dimethylaminoethylacrylamide, phenylacrylamide, dimethylacrylamide, diethylacrylamide, β-cyanoethylacrylamide, N—(2-acetoacetoxyethyl)acrylamide, diacetoneacrylamide, etc.

Specific examples of methacrylamides include methacrylamide, methylmethacrylamide, ethylmethacrylamide, propylmethacrylamide, butylmethacrylamide, tert-butyl-methacrylamide, cyclohexylmethacrylamide, benzylmethacrylamide, hydroxymethacrylamide, methoxyethylmethacrylamide, dimethylaminoethylmethacrylamide, phenylmethacrylamide, dimethylmethacrylamide, diethylmethacrylamide, β-cyanoethylmethacrylamide, N—(2-acetoacetoxyethyl)methacrylamide, etc.

Specific examples of olefins include dicyclopentadiene, ethylene, propylene, 1-butene, 1-pentene, vinyl chloride, vinylidene chloride, isoprene, chloroprene, butadiene, 2,3-dimethylbutadiene, etc.

Specific examples of styrenes include styrene, methylstyrene, dimethylstyrene, trimethylstyrene, ethyl styrene, isopropylstyrene, chloromethylstyrene, methoxystyrene, acetoxystyrene, chlorostyrene, dichlorostyrene, bromostyrene, vinyl benzoic acid methyl ester, etc.

Specific examples of vinyl ethers include methyl vinyl ether, butyl vinyl ether, hexyl vinyl ether, methoxyethyl vinyl ether, dimethylaminoethyl vinyl ether, etc.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N—vinyl pyrrolidone, acrylonitrile, methacrylonitrile, vinylidene chloride, methylene malononitrile, vinylidene, etc.

Two or more kinds of monomers (for example, those as described above) can be employed together to prepare the copolymers according to the present invention depending on the particular objective to be satisfied (for example, improvement in the solubility thereof, etc.). Further, for the purpose of adjusting the color forming property and solubility of the polymers, a monomer having an acid group as illustrated below can be employed as a comonomer so long as the copolymer obtained is not rendered water-soluble.

Specific examples of such monomers having an acid group include acrylic acid; methacrylic acid; itaconic acid, malaic acid; a monoalkyl itaconate, for example, monomethyl itaconate, monoethyl itaconate, monobutyl itaconate, etc.; a monoalkyl maleate, for example, monomethyl maleate, monoethyl maleate, monobutyl maleate, etc.; citraconic acid; styrene sulfonic acid; vinyl benzylsulfonic acid; vinylsulfonic acid; an acryloyloxyalkylsulfonic acid, for example, acryloxyloxymethylsulfonic acid, acryloyloxyethylsulfonic acid, acryloyloxypropylsulfonic acid, etc.; a methacryloyloxyalkylsulfonic acid, for example, methacryloyloxymethylsulfonic acid, methacryloyloxyethylsulfonic acid, methacryloyloxypropylsulfonic acid, etc.; an acrylamidoalkylsulfonic acid, for example, 2-acrylamido-2-methylethanesulfonic acid, 2-acrylamido-2-methylpropanesulfonic acid, 2-acrylamido-2-methylbutanesulfonic acid, etc.; a methacrylamidoalkylsulfonic acid, for example, 2-methacrylamido-2-methylethanesulfonic acid, 2-methacrylamido-2-methylpropanesulfonic acid, 2-methacrylamido-2-methylbutanesulfonic acid, etc.; etc.

The acid may be in the form of a salt of an alkali metal, for example, sodium, potassium, etc. or an ammonium ion.

Representative example of the other hydrophilic monomer is, for example, vinyl alcohol.

In the case where among the vinyl monomer described above and other vinyl monomer used in the present invention a hydrophilic monomer (which forms a water-soluble homopolymer when used alone) is employed as a comonomer, the ratio of the hydrophilic monomer contained in the copolymer is not strictly limited so long as the copolymer is not rendered water-soluble. Usually, the ratio of the hydrophilic monomer contained in the polymer is preferably not more than 40% per mol of copolymer, more preferably not more than 20% per mol of copolymer, and further more preferably not more than 10% per mol of copolymer. Further, when a hydrophilic comonomer copolymerizable with the vinyl monomer according to the present invention has an acid group, the ratio of the comonomer having an acid group contained in the copolymer is usually not more than 20% per mol of copolymer, and preferably not more than 10% per mol of copolymer. In the most preferred case, the copolymer does not contain such a hydrophilic comonomer having an acid group.

Preferred monomers for preparing the polymer according to the present invention are methacrylate monomers, acrylamide monomers and methacrylamide monomers. Further, it is usually preferred to copolymerize two or more monomers. A copolymer of acrylamide monomers and (an)other monomer(s) according to the present invention and a copolymer of methacrylate type monomers and (an)other monomer(s) according to the present invention are particularly preferred. Moreover, two or more polymers can naturally be employed together. The acrylamide monomers and methacrylamide monomers each may be substituted with a substituent at a nitrogen atom therein.

(B) Polyester resins obtained by condensation of polyvalent alcohols and polybasic acids Useful polyvalent alcohols include a glycol having the structure HO—$R_1$,—OH (where $R_1$, represents a hydrocarbon chain having from 2 to about 12 carbon atoms, particularly an aliphatic hydrocarbon chain) and a polyalkylene glycol, and useful polybasic acids include those represented by the formula HOOC—$R_2$,—COOH (where $R_2$, represents a single bond or a hydrocarbon chain having from 1 to about 12 carbon atoms).

Specific examples of the polyvalent alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,4-butanediol, glycerol, diglycerol, triglycerol, 1-methylglycerol, erythritol, manitol, sorbitol, etc.

Specific examples of the polybasic acids include oxalic acid, succinic acid, glutaric- acid, adipic acid, pimelic acid, cork acid (suberic acid), azelaic acid, sebacic acid, nonanedicarboxylic acid, decanedicarboxylic acid, undecanedicarboxylic acid, dodecandicarboxylic acid, fumaric acid, maleic acid, itaconic acid, citraconic acid, phthalic acid, isophthalic acid, terephthalic acid, tetrachlorophthalic acid, mesaconic acid, isopimelic acid, cyclopentadiene-maleic anhydride adduct, rosin-maleic anhydride adduct, etc.

(C) Other polymers

A polyester obtained by open ring condensation as shown below is exemplified.

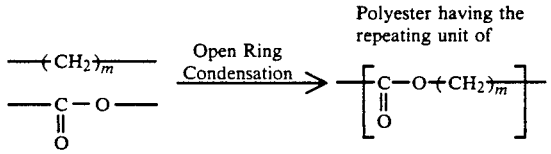

wherein m represents an integer from 4 to 7 and the —$CH_2$-chain may be a branched chain.

Suitable monomers for preparation of the polyester include β-propiolactone, ε-caprolactone, dimethylpropiolactone, etc.

Molecular weight and degree of polymerization of the polymer according to the present invention do not have a substantial influence on the effect of the present invention. However, as the molecular weight becomes higher, some problems are apt to occur, such as a slow rate of dissolution in an auxiliary solvent and difficulty in emulsification or dispersion thereof due to the high viscosity of the solution. Difficult emulsification or dispersion causes coarse grains to be formed, which, in turn, results in a decrease in color forming property and coating property When a large amount of auxiliary solvent is used to reduce viscosity in order to overcome such difficulties, new problems in processing may occur. From such a point of view, the viscosity of the polymer is preferably not more than 5,000 cps, more preferably not more than 2,000 cps, when 30 g of the polymer is dissolved in 100 ml of the auxiliary solvent used. Also, the weight average molecular weight of the polymer used in the present invention is preferably not more than 150,000, more preferably not more than 80,000.

The ratio of the polymer to auxiliary solvent depends on the kind of polymer used and can be varied over a wide range depending on its solubility in the auxiliary solvent, its degree of polymerization, and solubility of the coupler, etc. Usually the auxiliary solvent is employed in an amount needed to make the viscosity sufficiently low for easily dispersing a solution containing at least a coupler, a coupler solvent having a high boiling point and the polymer dissolved in the auxiliary solvent in water or an aqueous solution of a hydrophilic colloid. Since the viscosity of the solution increases with the degree of polymerization of the polymer, it is difficult to set forth a ratio of the polymer to an auxiliary solvent that would apply to every polymer. Usually, however, a ratio of about 1:1 to about 1:50 (by weight) is preferred. The ratio of the polymer according to the present invention to the cyan coupler is preferably from 1:20 to 20:1, more preferably from 1:10 to 10:1 (by weight).

Specific examples of polymers which can be used in the present invention are set forth in part below, but the present invention should not be construed as being limited to these polymers.

P-1: Polyvinyl acetate
P-2: Polyvinyl propionate
P-3: Polymethyl methacrylate
P-4: Polyethyl methacrylate
P-5: Polyethyl acrylate
P-6: Vinyl acetate/vinyl alcohol (95:5) copolymer
P-7: Poly-n-butyl acrylate
P-8: Poly-n-butyl methacrylate
P-9: Polyisobutyl methacrylate
P-10: Polyisopropyl methacrylate
P-11: Polyoctyl acrylate
P-12: n-Butyl acrylate/acrylamide (95:5) copolymer
P-13: Stearyl methacrylate/acrylic acid (90:10) copolymer
P-14: 1,4-Butanediol/adipic acid polyester
P-15: Ethylene glycol/sebacic acid polyester
P-16: Polycaprolactone
P-17: Polypropiolactone
P-18: Polydimethylpropiolactone
P-19: n-Butyl methacrylate/N—vinyl-2-pyrrolidone (90:10) copolymer
P-20: Methyl methacrylate/vinyl chloride (70:30) copolymer
P-21: Methyl methacrylate/styrene(90:10) copolymer
P-22: Methyl methacrylate/ethyl acrylate(50:50) copolymer
P-23: n-Butyl methacrylate/mathyl methacrylate/styrene (50:30:20) copolymer
P-24: Vinyl acetate/acrylamide (85:15) copolymer
P-25: Vinyl chloride/vinyl acetate (65:35) copolymer
P-26: Methyl methacrylate/acrylonitrile (65:35) copolymer
P-27: Diacetoneacrylamide/methyl methacrylate (50:50) copolymer
P-28: Methyl vinyl ketone/isobutyl methacrylate (55:45) copolymer
P-29: Ethyl methacrylate/n-butyl acrylate (70:30) copolymer
P-30: Diacetoneacrylamide/n-butyl acrylate (60:40) copolymer
P-31: Methyl methacrylate/styrenemethyl methacrylate/ diacetoneacrylamide (40:40:20) copolymer
P-32: n-Butyl acrylate/styrene methacrylate/-diacetoneacrylamide (70:20:10) copolymer
P-33: Stearyl methacrylate/methyl methacrylate/acrylic acid (50:40:10) copolymer
P-34: Methyl methacrylate/styrene/vinylsulfonamide (70:20:10) copolymer
P-35: Methyl methacrylate/phenyl vinyl ketone (70:30) copolymer
P-36: n-Butyl acrylate/methyl methacrylate/n-butyl methacrylate (35:35:30) copolymer
P-37: n-Butyl methacrylate/pentyl methacrylate/-N—vinyl-2-pyrrolidone (38:38:24) copolymer
P-38: Methyl methacrylate/n-butyl methacrylate/isobutyl methacrylate/acrylic acid (37:29:25:9) copolymer
P-39: n-Butyl methacrylate/acrylic acid (95:5) copolymer
P-40: Methyl methacrylate/acrylic acid (95:5) copolymer
P-41: Benzyl methacrylate/acrylic acid (90:10) copolymer
P-42: n-Butyl methacrylate/methyl methacrylate/benzyl methacrylate/acrylic acid (35:35:25:5)
P-43: n-Butyl methacrylate/methyl methacrylate/benzyl methacrylate (35:35:30) copolymer
P-44: Polypentyl acrylate
P-45: Cyclohexyl methacrylate/methyl methacrylate/n-propyl methacrylate (37:29:34) copolymer
P-46: Polypentyl methacrylate
P-47: Methyl methacrylate/n-butyl methacrylate (65:35) copolymer
P-48: Vinyl acetate/vinyl propionate (75:25) copolymer
P-49: n-Butyl methacrylate/sodium 3-acryloxybutane-1-sulfonate (97:3) copolymer
P-50: n-Butyl methacrylate/methyl methacrylate/acrylamide (35:35:30) copolymer
P-51: n-Butyl methacrylate/methyl methacrylate/vinyl chloride (37:36:27) copolymer
P-52: n-Butyl methacrylate/styrene (90:10) copolymer
P-53: Methyl methacrylate/N—vinyl-2-pyrrolidone (90:10) copolymer
P-54: n-Butyl methacrylate/vinyl chloride (90:10) copolymer
P-55: n-Butyl methacrylate/styrene (70:30) copolymer
P-56: Poly(N—sec-butylacrylamide)
P-57: Poly(N—tert-butylacrylamide)
P-58: Diacetoneacrylamide/methyl methacrylate (62:38) copolymer
P-59: Polycyclohexyl methacrylate
P-60: N—tert-butylacrylamide/methyl methacrylate (40:60) copolymer
P-61: Poly(N,N—dimethylacrylamide)
P-62: Poly(tert-butylmethacrylate)
P-63: tert-Butyl methacrylate/methyl methacrylate (70:30) copolymer
P-64: Poly(N—tert-butylmethacrylamide)
P-65: N—tert-butylacrylamide/methylphenyl methacrylate (60:40) copolymer
P-66: Methyl methacrylate/acrylonitrile (70:30) copolymer
P-67: Methyl methacrylate/methyl vinyl ketone (38:62) copolymer
P-68: Methyl methacrylate/styrene (75:25) copolymer
P-69: Methyl methacrylate/hexyl methacrylate (70:30) copolymer In the above-described copolymers, ratio of monomers copolymerized denotes a weight ratio.

The cyan couplers represented by general formula (I) will now be described in detail.

In general formula (I), $R_1$ represents a hydrogen atom or a halogen atom. The alkyl group represented by $R_2$ may be any of a straight chain, branched chain and cyclic alkyl group and preferably has from 1 to 32 carbon atoms, for example, a methyl group, an ethyl group, a propyl group, a butyl group, a pentadecyl group, a tert-butyl group, a cyclohexyl group, etc.

The alkyl group for $R_2$ may be substituted by one or more groups selected from an alkyl group, an aryl group, a heterocyclic group, an alkoxy group (for example, a methoxy group, a 2-methoxyethoxy group, etc.), an aryloxy group (for example, a 2,4-di-tert-amylphenoxy group, a 2-chlorophenoxy group, a 4-cyanophenoxy group, etc.), an alkenyloxy group (for example, a 2-propenyloxy group, etc.), an acyl group (for example, an acetyl group, a benzoyl group, etc.), an ester group (for example, a butoxycarbonyl group, a phenoxycarbonyl group, an acetoxy group, a benzoyloxy group, a butoxysulfonyl group, a toluenesulfonyloxy group, etc.), an amido group (for example, an acetylamino group, a methanesulfonamido group, a dipropylsulfamoylamino group, etc.), a carbamoyl group (for example, a dimethylcarbamoyl group, an ethylcarbamoyl group, etc.), a sulfamoyl group (for example, a butylsulfamoyl group, etc.), an imido group (e.g., a succinimido group, a hydantoinyl group, etc.), a ureido group (for example, a phenylureido group, a dimethylureido group, etc.), an aliphatic or aromatic sulfonyl group (for example, a methanesulfonyl group, a phenylsulfonyl group, etc.), an aliphatic or aromatic thio group (for example, an ethylthio group, a phenylthio group, etc.), a hydroxyl group, a cyano group, a carboxyl group, a nitro group, a sulfo group, and a halogen atom, etc.

The ballast group represented by $R_3$ includes a substituted or unsubstituted aliphatic group, a substituted or unsubstituted aromatic group and a substituted or unsubstituted heterocyclic group. Suitable examples of the aliphatic group which preferably has from 1 to 32 carbon atoms include a methyl group, a butyl group, a tridecyl group, a cyclohexyl group, an allyl group, etc. Suitable examples of the aryl group include a phenyl group, a naphthyl group, etc. Suitable examples of the heterocyclic group include a 2-pyridyl group, a 2-imidazolyl group, a 2-furyl group, a 6-quinolyl group, etc. These groups may be substituted with one or more substituents as described with respect to $R_2$.

In general formula (I), (II), (III) or (IV), when $Y_1$, $Y_2$, $Y_3$ or $Y_4$ represents a releasing group, the releasing group includes a group capable of connecting a couplingactive carbon atom to an aliphatic group, an aromatic group, a heterocyclic group, an aliphatic, aromatic, or heterocyclic sulfonyl group, or an aliphatic, aromatic, or heterocyclic carbonyl group via an oxygen atom, a nitrogen atom, a sulfur atom, or a carbon atom; a halogen atom; an aromatic azo group; etc. The aliphatic, aromatic, or heterocyclic group contained in the releasing group may be substituted with one or more substituents as described with respect to $R_2$. When two or more substituents are present, these substituents may be either the same or different. Further, the substituent or substituents may further be substituted with one or more substituents as described with respect to $R_2$.

Specific examples of the releasing group include a halogen atom (for example, a fluorine atom, a chlorine atom, a bromine atom, etc.); an alkoxy group (for example, an ethoxy group, a dodecyloxy group, a methoxyethylcarbamoylmethoxy group, a carboxylpropyloxy group, a methylsulfonylethoxy group, etc.); an aryloxy group (for example, a 4-chlorophenoxy group, a 4-methoxyphenoxy group, a 4-carboxyphenoxy group, etc.); an acyloxy group (for example, an acetoxy group, a tetradecanoyloxy group, a benzoyloxy group, etc.); an aliphatic or aromatic sulfonyloxy group (for example, a methanesulfonyloxy group, a toluenesulfonyloxy group, etc.); an acylamino group (for example, a dichloroacetylamino group, a heptafluorobutyrylamino group, etc.); an aliphatic or aromatic sulfonamido group (for example, methanesulfonamido group, a p-toluenesulfonylamido group, etc.); an alkoxycarbonyloxy group (for example, an ethoxycarbonyloxy group, a benzyloxycarbonyloxy group, etc.); an aryloxycarbonyloxy group (for example, a phenoxycarbonyloxy group, etc.); an aliphatic, aromatic, or heterocyclic thio group (for example, an ethylthio group, a phenylthio group, a tetrazolylthio group, etc.); a carbamoylamino group (for example, an N-methylcarbamoylamino group, an N-phenylcarbamoylamino group, etc.); a 5- or 6-membered nitrogen-containing heterocyclic group (for example, an imidazolyl group, a pyrazolyl group, a triazolyl group, a tetrazolyl group, a 1,2-dihydro-2-oxo-1-pyridyl group, etc.); an imido group (for example, a succinimido group, a hydantoinyl group, etc.); an aromatic azo group (for example, a phenylazo group); etc. These groups may be substituted by one or more substituents as described with respect to $R_2$. Examples of the releasing group bonded via a carbon atom include bistype couplers obtained by condensing four-equivalent couplers with aldehydes or ketones. The releasing group used in the present invention may contain a photographically useful group such as a development inhibitor or a development accelerator, etc.

Preferable examples of cyan couplers represented by general formula (I) are now given.

$R_1$ in general formula (I) preferably represents a halogen atom and particularly preferably a chlorine atom or a fluorine atom.

$R_2$ in general formula (I) preferably represents an alkyl group having from 2 to 15 carbon atoms or a methyl group having a substituent having 1 or more carbon atoms. As the substituent, an arylthio group, an alkylthio group, an acylamino group, an aryloxy group, and an alkoxy group are preferable.

$R_3$ in general formula (I) preferably represents a substituted or unsubstituted alkyl or aryl group, and more preferably an alkyl group substituted with a substituted aryloxy group or an unsubstituted straight chain alkyl group.

$Y_1$ in general formula (I) preferably represents a hydrogen atom, a halogen atom, an alkoxy group, an aryloxy group, an acyloxy group, or a sulfonamido group.

The substituents for the cyan couplers represented by general formula (I) are described, in detail, in U.S. Pat. Nos. 2,369,929, 4,518,687, 4,511,647, 3,772,002, and 4,564,590.

Specific examples of cyan couplers which can be used in the present invention are set forth below, but the present invention should not be construed a being limited thereto.

(I-1)
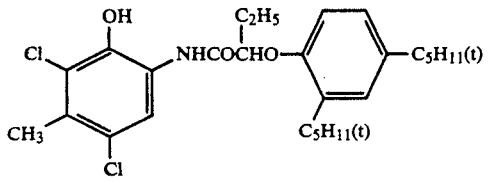
(I-2)
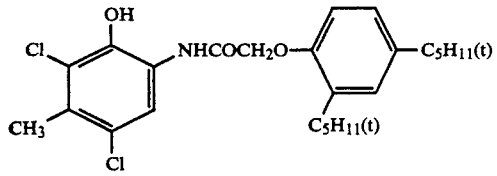
(I-3)
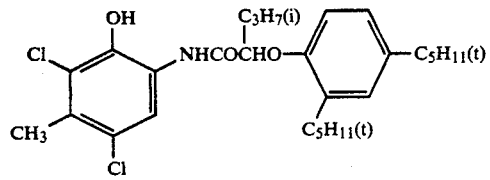
(I-4)
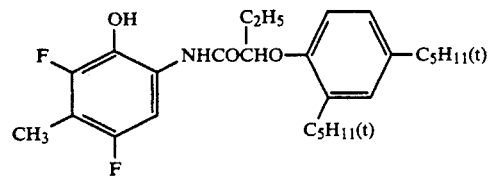
(I-5)
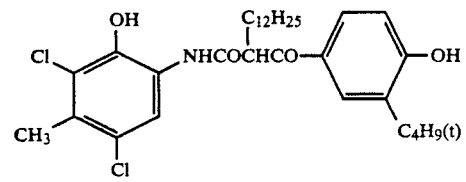
(I-6)
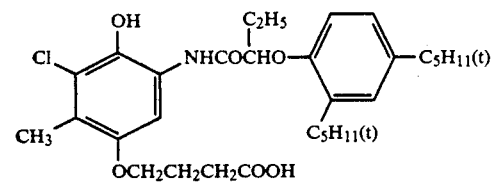
(I-7)
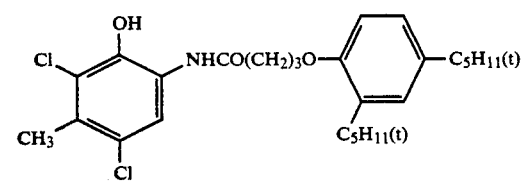
(I-8)
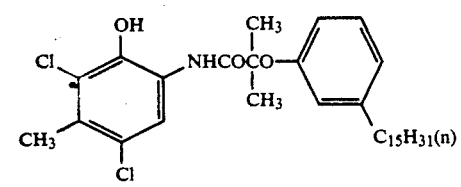

-continued
(I-9)
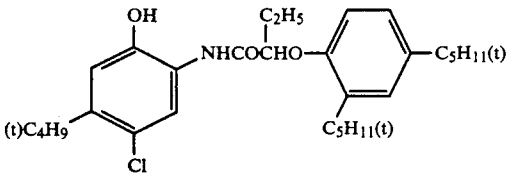
(I-10)
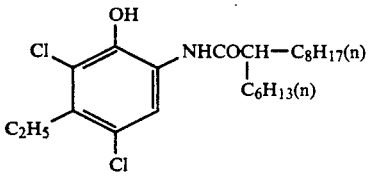
(I-11)
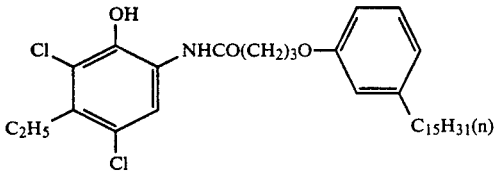
(I-12)
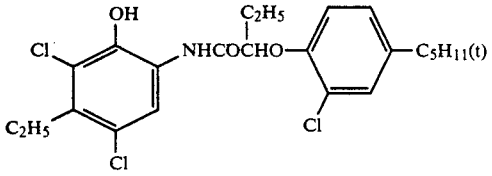
(I-13)
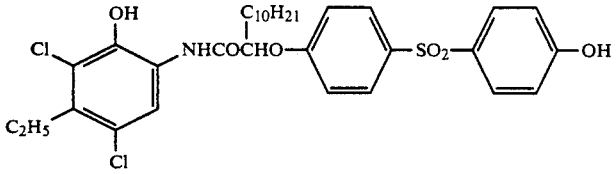
(I-14)
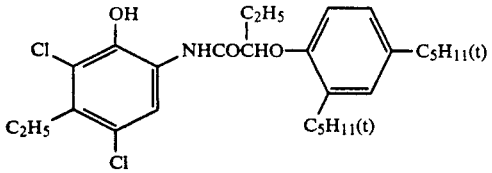
(I-15)
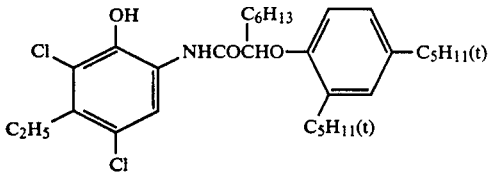
(I-16)
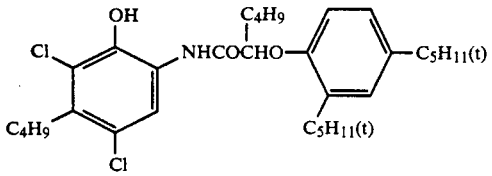

-continued
(I-17)
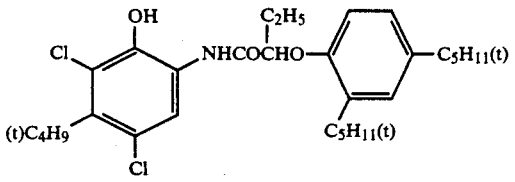
(I-18)
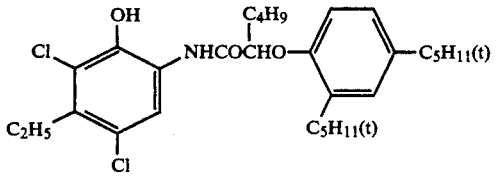
(I-19)
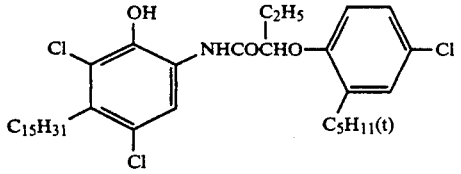
(I-20)
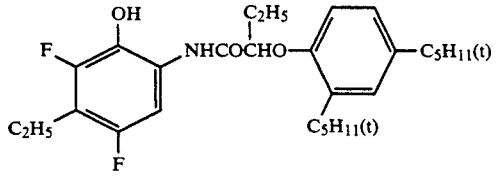
(I-21)
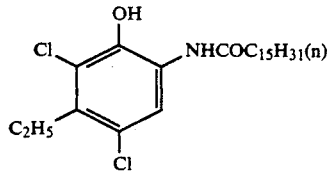
(I-22)
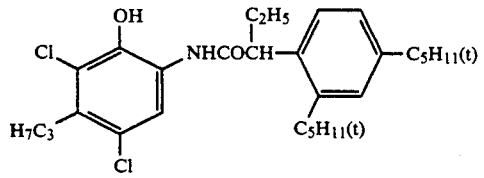
(I-23)
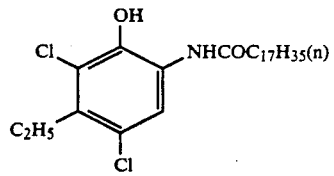
(I-24)
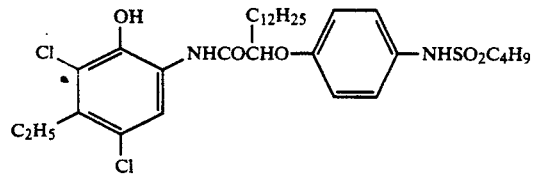

-continued
(I-25)
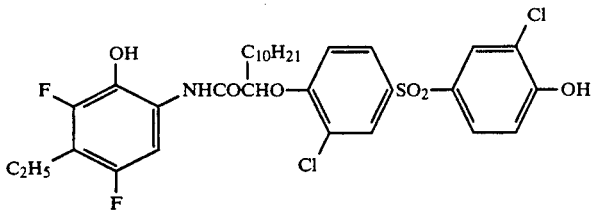
(I-26)
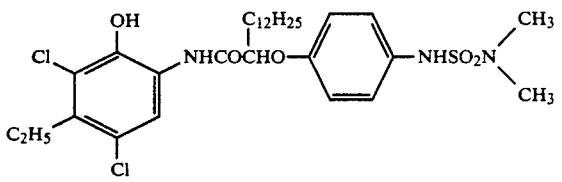
(I-27)
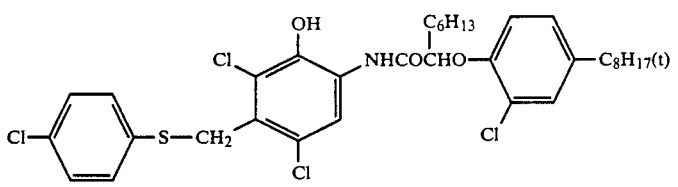
(I-28)
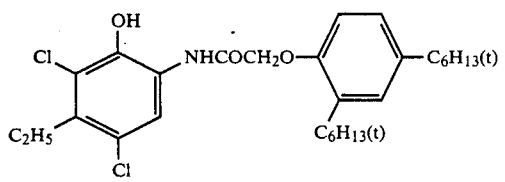
(I-29)
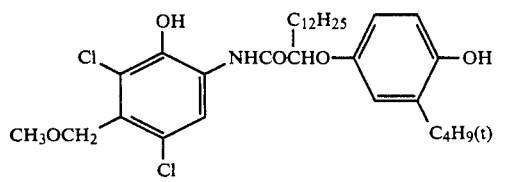
(I-30)
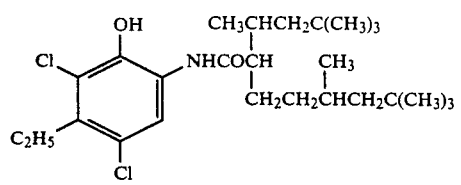
(I-31)
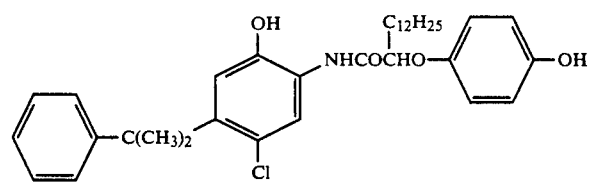
(I-32)
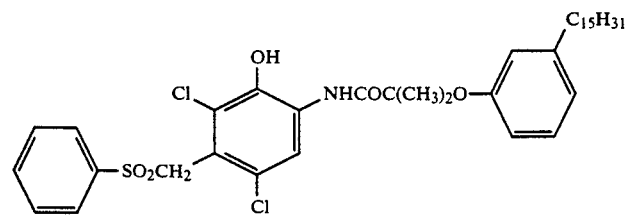

-continued (I-33)

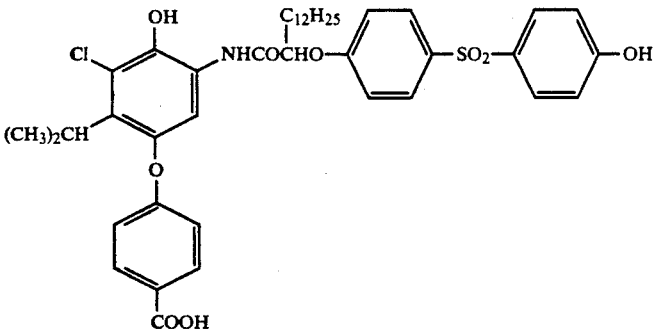

The magenta couplers represented by general formula (II) are now described in detail.

In general formula (II), when $R_5$ is a hydrogen atom, it is known in the art that the magenta coupler shows ketoenol tautomerism as illustrated below.

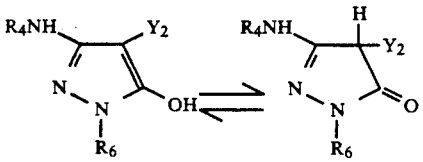

In general formula (II), the aryl group (preferably a phenyl group) represented by $R_4$ or $R_6$ may be substituted with one or more substituents as described with respect to $R_2$. When two or more substituents are present, they may be the same or different.

In general formula (II), $R_5$ preferably represents a hydrogen atom, an aliphatic acyl group or an aliphatic sulfonyl group, and more preferably a hydrogen atom. $Y_2$ preferably represents a sulfur-atom-linked releasing group, an oxygen-atom-linked releasing group and a nitrogen-atom-linked releasing group, and more preferably a sulfur-atom-linked releasing group.

The magenta couplers represented by general formula (III) are now described in detail.

The compounds represented by general formula (III) are 5-membered ring-condensed nitrogen-atom-containing heterocyclic 5-membered ring type couplers (hereafter referred to as 5,5-N-heterocyclic couplers). Their color forming nuclei show aromaticity isoelectronic to naphthalene and have chemical structures inclusively called azapentalene.

Preferred of the couplers represented by general formula (III) are 1H-imidazo[1,2-b]pyrazoles, 1H-pyrazolo[1,5-b]pyrazoles, 1H-pyrazolo[5,1-c][1,2,4]triazoles, 1H-pyrazolo1,5-b][1,2,4]triazoles and 1H-pyrazolo[1,5-d]tetrazoles represented by general formulae (V), (VI), (VII), (VIII) and (IX) now described, respectively.

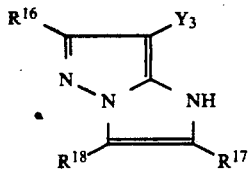

(V)

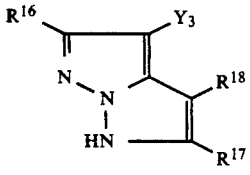

(VI)

-continued

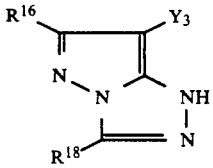

(VII)

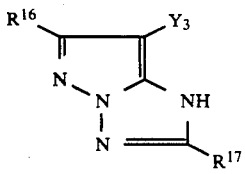

(VIII)

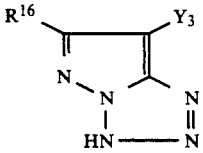

(IX)

wherein $R_{16}$, $R_{17}$ and $R_{18}$ each represents an aliphatic group, an aromatic group, a heterocyclic group, $$RO-,\ R\underset{\underset{O}{\|}}{C}-,\ R\underset{\underset{O}{\|}}{C}O-,\ RSO-,\ RSO_2-,\ RSO_2NH-,$$

$$R\underset{\underset{O}{\|}}{C}NH-,\ RNH-,\ RS-,\ RO\underset{\underset{O}{\|}}{C}NH-$$

(wherein R represents an alkyl group, an aryl group or a heterocyclic group), a hydrogen atom, a halogen atom, a cyano group, an imido group, a carbamoyl group, a sulfamoyl group, a ureido group or a sulfamoylamino group; $Y_3$ has the same meaning as earlier defined, or $R_{16}$, $R_{17}$, $R^{18}$ or $Y_3$ may be a divalent group to form a dimer or may be a divalent group for linking the coupler moiety to a polymer chain.

The aliphatic group, aromatic group or heterocyclic group represented by $R_{16}$, $R_{17}$ or $R_{18}$ may be substituted with one or more substituents as described with respect to $R_2$. Further, a nitrogen atom in the carbamoyl group, sulfamoyl group, ureido group or sulfamoylamino group may be substituted with one or more substituents as described with respect to $R_2$.

In general formulae (V), (VI), (VII), (VIII) and (IX), $R_{16}$, $R_{17}$ and $R_{18}$ each preferably represents a hydrogen atom, a halogen atom, an aliphatic group, an aromatic group, a heterocyclic group, RO—, RCONH—, $RSO_2NH$—, RNH—, RS—or ROCONH—. $Y_3$ preferably represents a halogen atom, an acylamino group, an imido group, an aliphatic or aromatic sulfonamido group, a 5-membered or 6-membered nitrogen-containing heterocyclic group connecting to the coupling active position at the nitrogen atom, an aryloxy group, an alkoxy group, an arylthio group or an alkylthio group.

The substituents for the magenta couplers represented by general formula (II) are described, in detail, in U.S. Pat. Nos. 2,311,082, 2,343,703, 2,600,788, 2,908,573, 3,062,653, 3,152,896, 3,936,015, 4,310,619, and 4,351,897.

The substituents for the magenta couplers represented by general formula (III) are described, in detail, in U.S. Pat. Nos. 3,369,879, 3,725,067, and 4,540,654 (particularly, column 2, line 4 to column 8, line 27).

Specific examples of preferred magenta couplers represented by general formula (II) or (III) are now set forth, but the present invention should not be construed as being limited thereto.

(II-1)

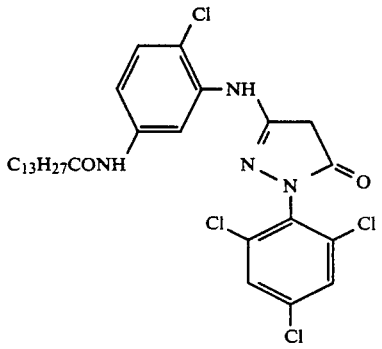

(II-2)

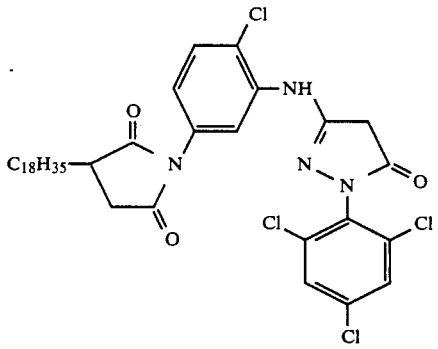

(II-3)

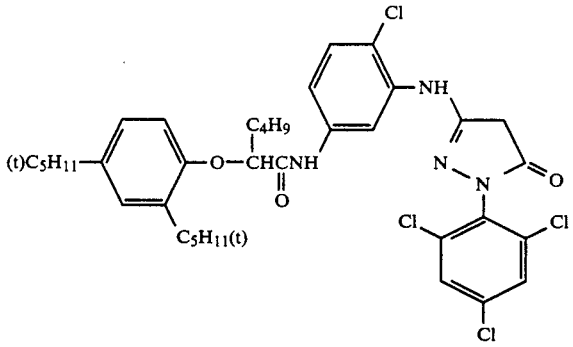

(II-4)

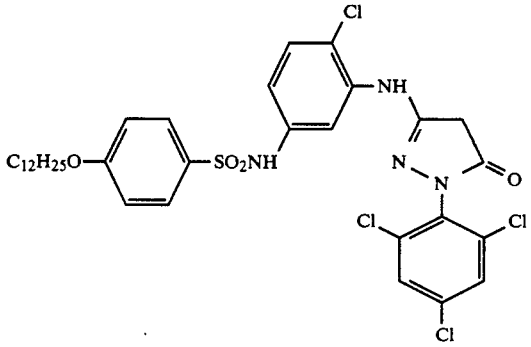

-continued
(II-5)
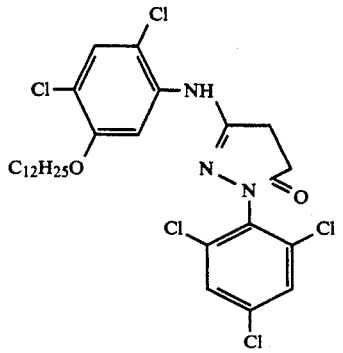
(II-6)
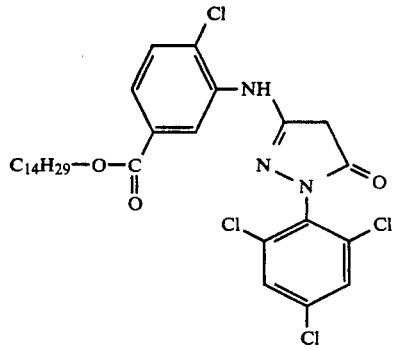
(II-7)
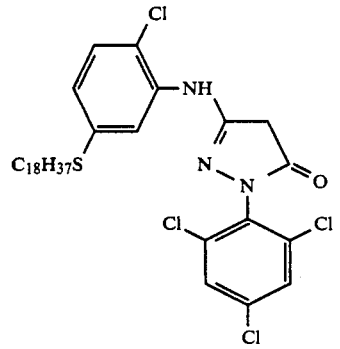
(II-8)
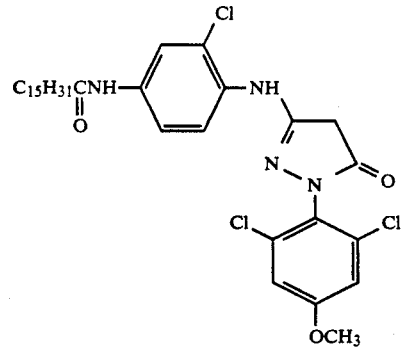
(II-9)
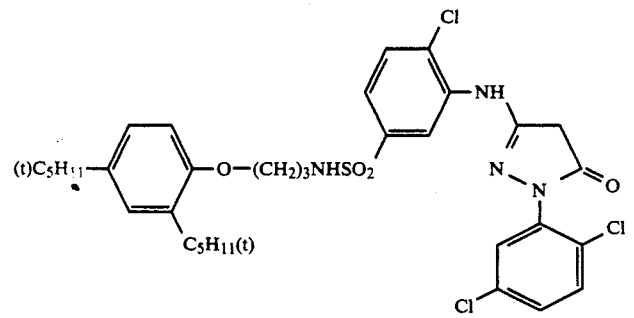

-continued
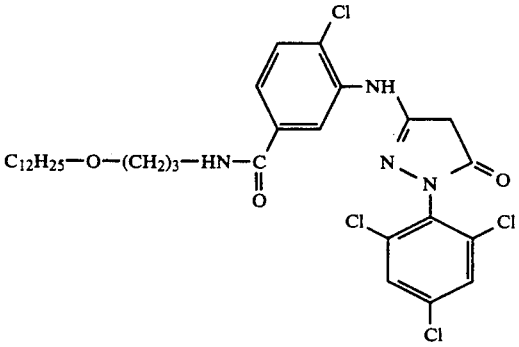
(II-10)
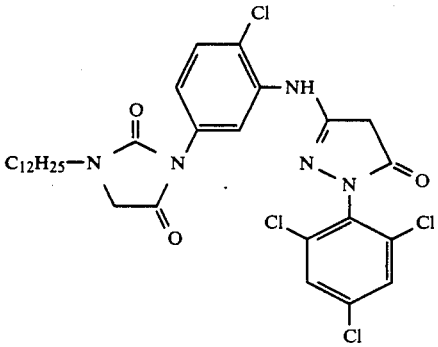
(II-11)
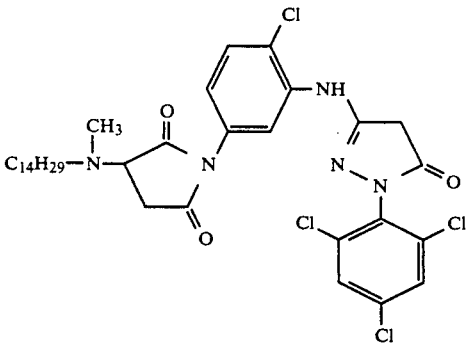
(II-12)
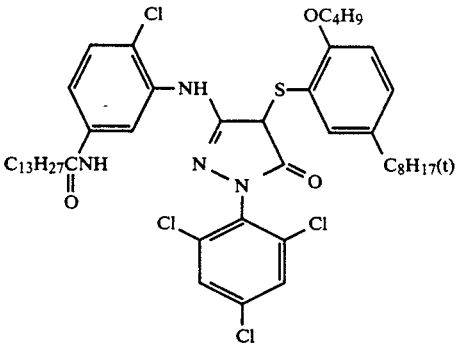
(II-13)

-continued
(II14)
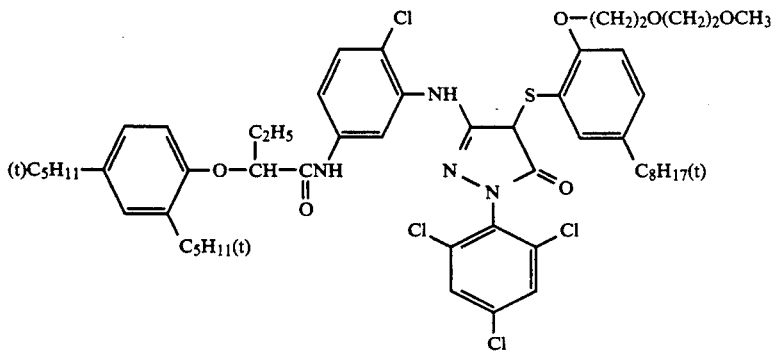
(II-15)
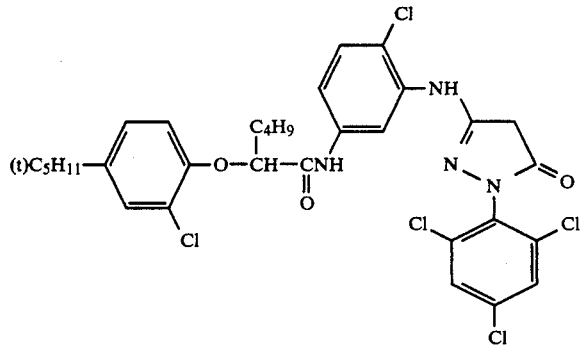
(III-1)
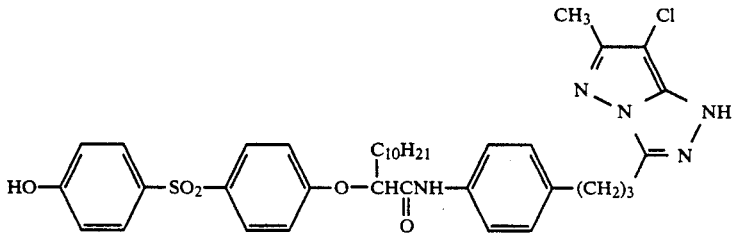
(III-2)
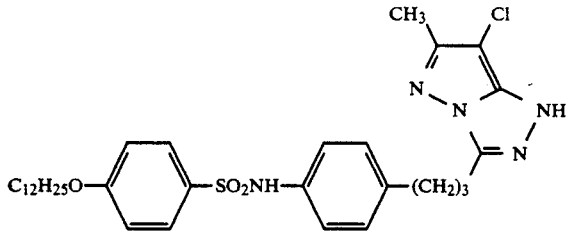
(III-3)
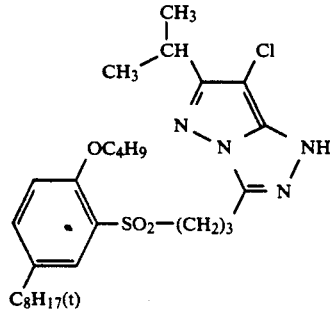

-continued
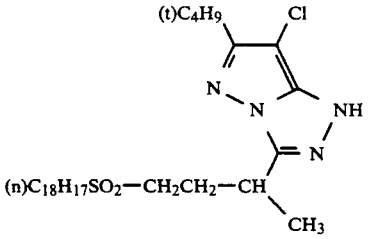
(III-4)
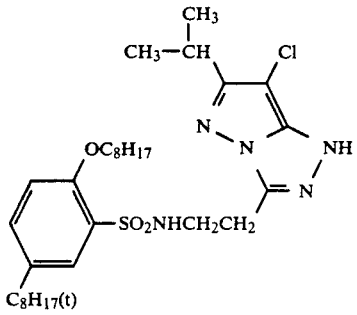
(III-5)
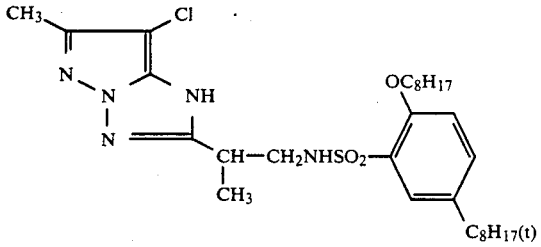
(III-6)
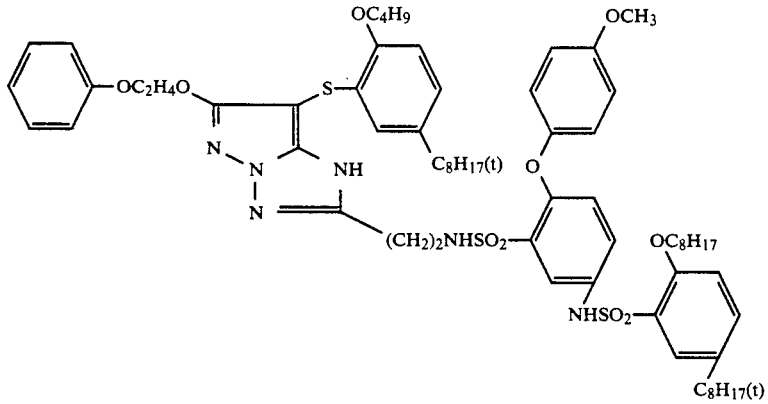
(III-7)
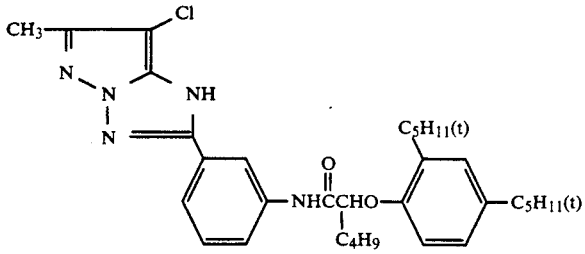
(III-8)

-continued
(III-9)
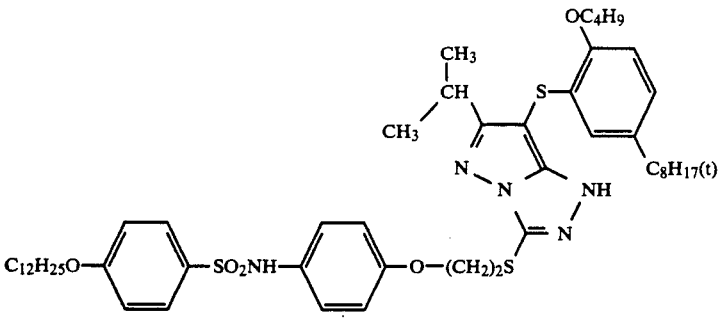
(III-10)
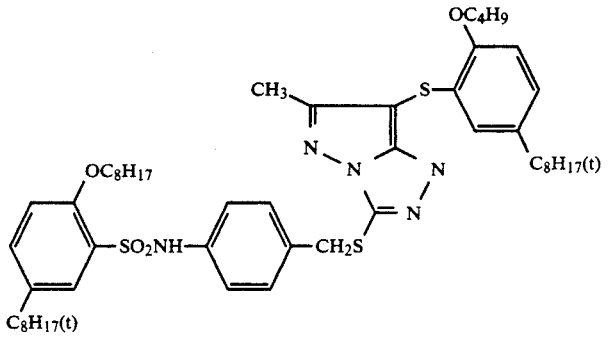
(III-11)
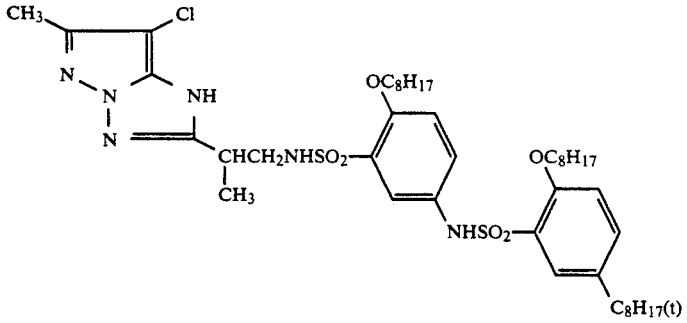
(III-12)
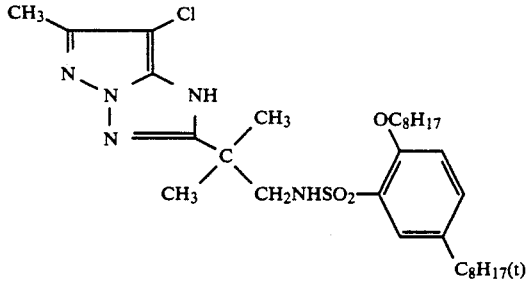
(III-13)
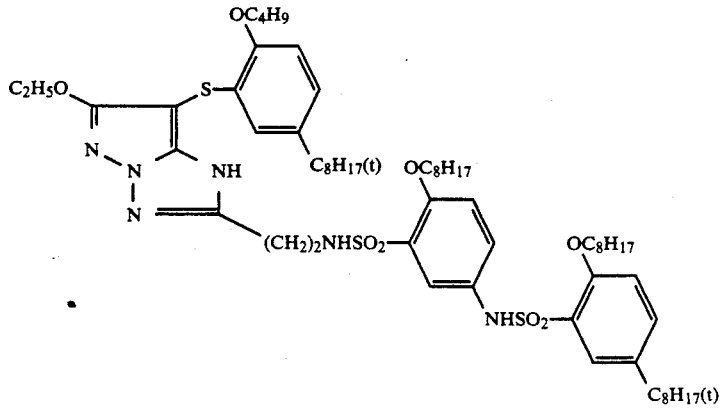

-continued
(III-14)
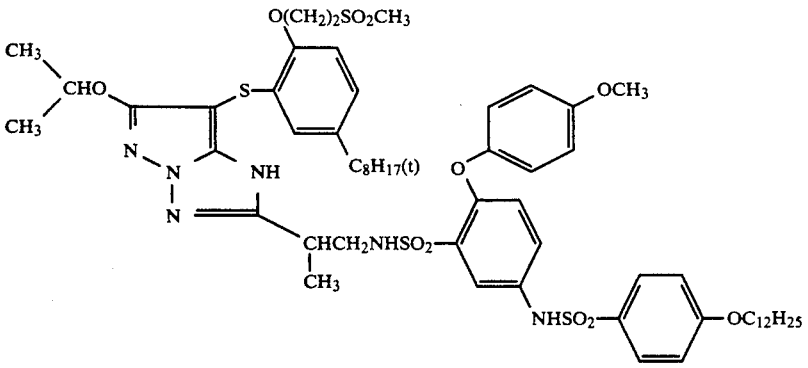
(III-15)
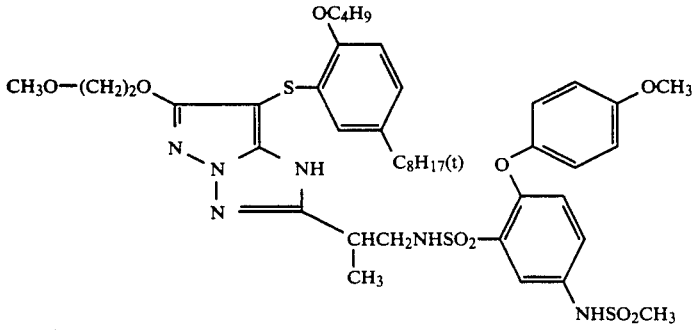
(III-16)
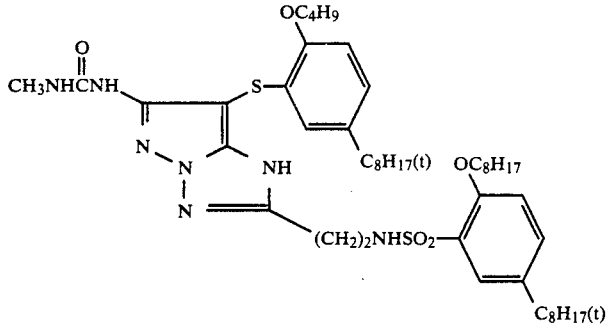
(III-17)
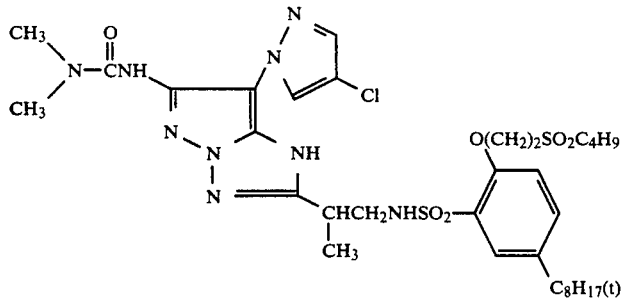
(III-18)
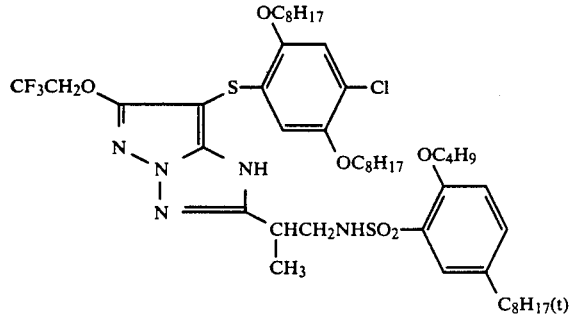

-continued
(III-19)
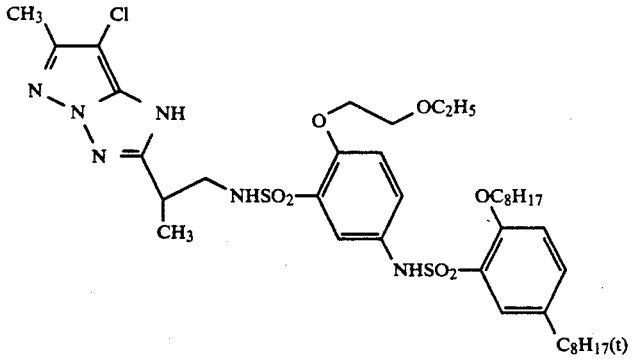
(III-20)
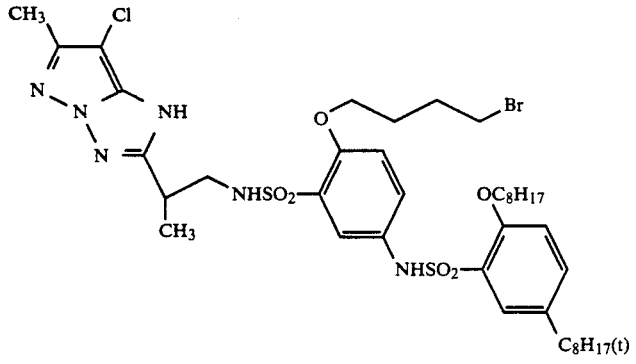
(III-21)
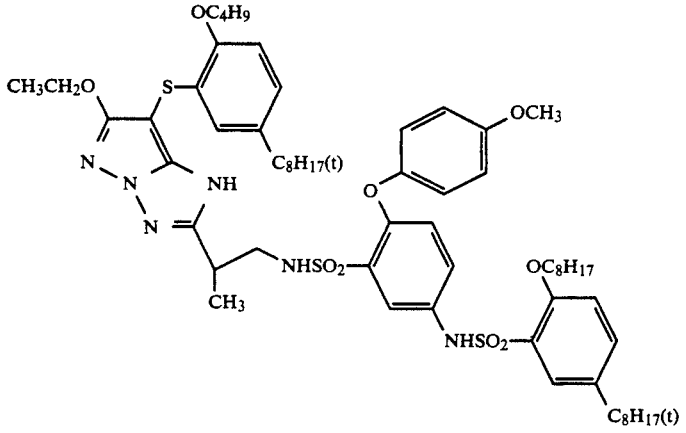
(III-22)
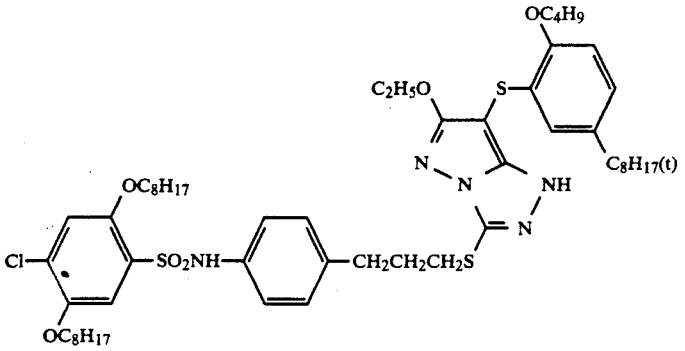

-continued
(III-23)
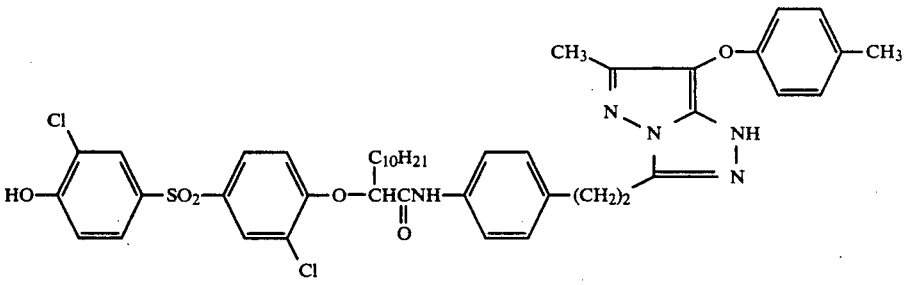
(III-24)
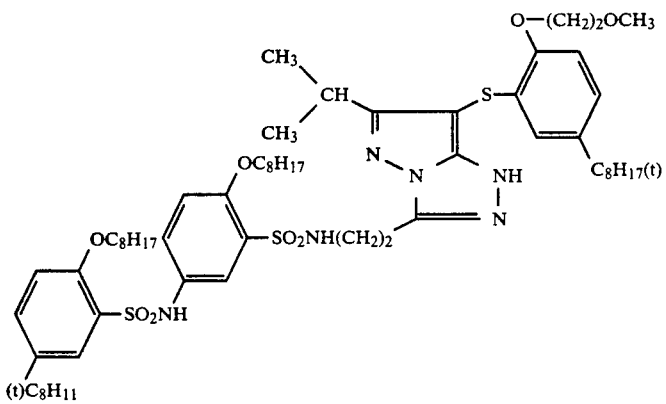
(III-25)
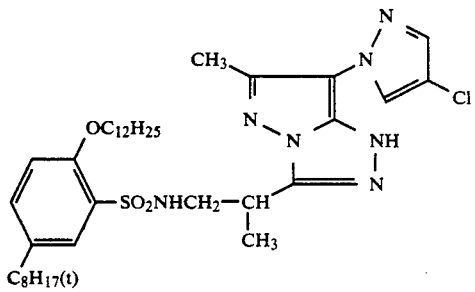
(III-26)
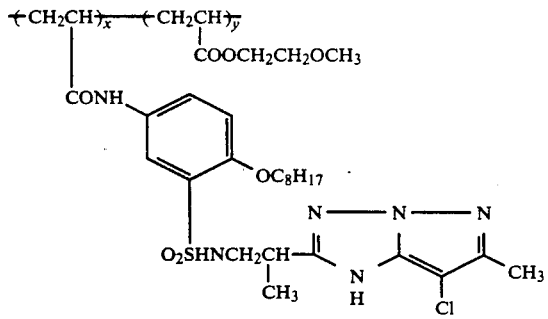
x/y = 45/55
(III-27)
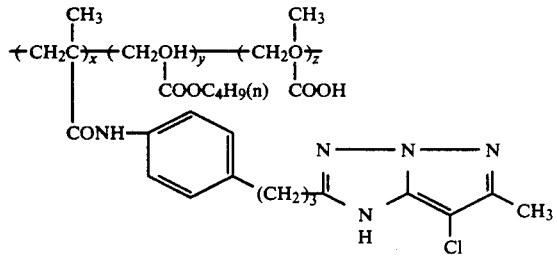
x/y/z = 50/45/5

-continued
(III-28)
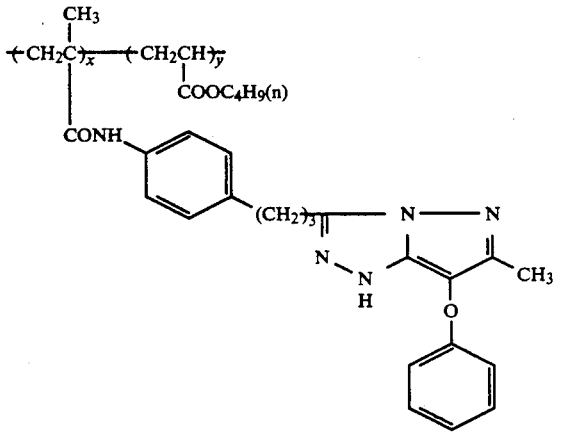
x/y = 50/50
(III-29)
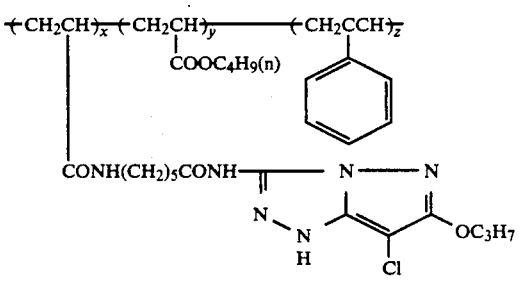
x/y/z = 45/50/5
(III-30)
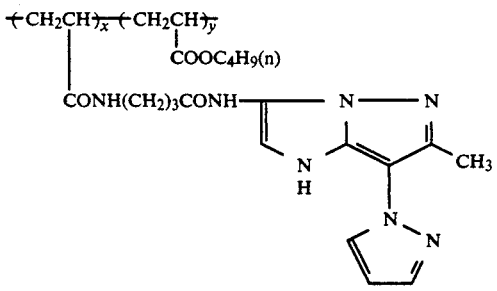
x/y = 50/50
(III-31)
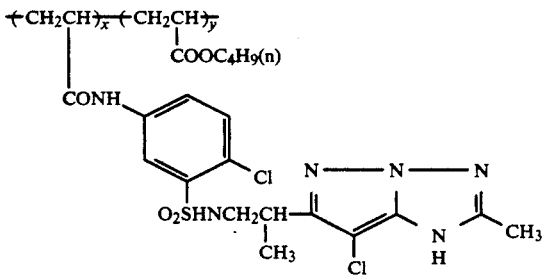
x/y = 50/50

-continued (III-32)

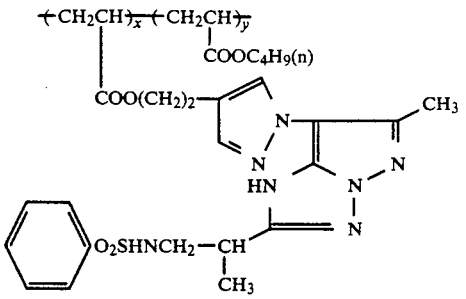

x/y = 45/55

In the above-described formulae, x, y and z each denotes a weight ratio.

The yellow couplers represented by general formula (IV) are now described in detail.

In general formula (IV), the group represented by $R_8$, $R_9$, $R_{10}$ or $R_{11}$ may be substituted with one or more substituents as described with respect to $R_2$. The releasing group represented by Y4 preferably includes a group represented by the following general formula (X), (XI), (XII) or (XIII):

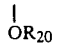

(X)

wherein $R_{20}$ represents an aryl group which may be substituted or a heterocyclic group which may be substituted,

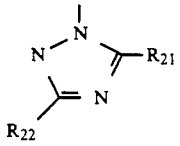

(XI)

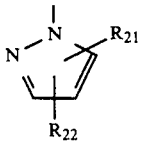

(XII)

wherein $R_{21}$ and $R_{22}$, which may be the same or different, each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group (COOH), a sulfonic acid group, an unsubstituted or substituted phenyl group or an unsubstituted or substituted heterocyclic group, (XIII)

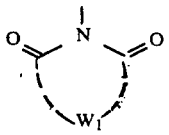

wherein $W_1$ represents the non-metallic atoms necessary for forming a 4-membered, 5-membered or 6-membered ring together with

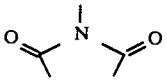

in the formula

Of the groups represented by general formula (XIII), those represented by the following general formulae (XIV) to (XVI) are preferable:

(XIV)

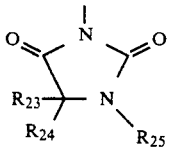

(XV)

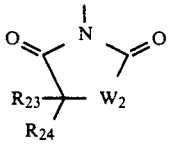

(XVI)

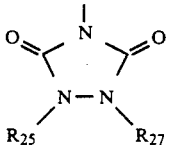

wherein $R_{23}$ and $R_{24}$ each represents a hydrogen atom, an alkyl group, an aryl group, an alkoxy group, an aryloxy group or a hydroxyl group; $R_{25}$, $R_{26}$ and $R_{27}$ each represents a hydrogen atom, an alkyl group, an aryl group, an aralkyl group or an acyl group; and $W_2$ represents an oxygen atom or a sulfur atom.

The substituents for the yellow couplers represented by general formula (IV) are described, in detail, in U.S. Pat. Nos. 4,622,287 (particularly, column 3, line 15 to column 8, line 39) and 4,623,616 (particularly, column 14, line 50 to column 19, line 41).

Specific examples of yellow couplers represented by general formula (IV) are set forth below, but the present invention should not be construed as being limited thereto.

(IV-1)
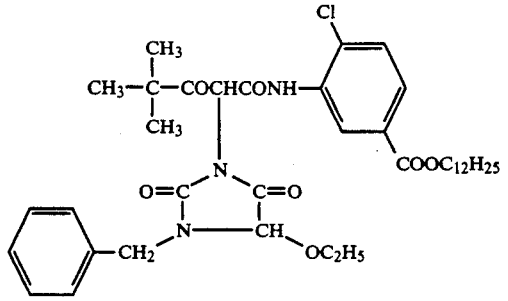
(IV-2)
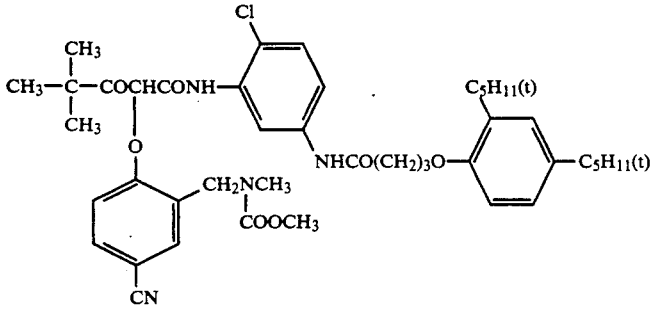
(IV-3)
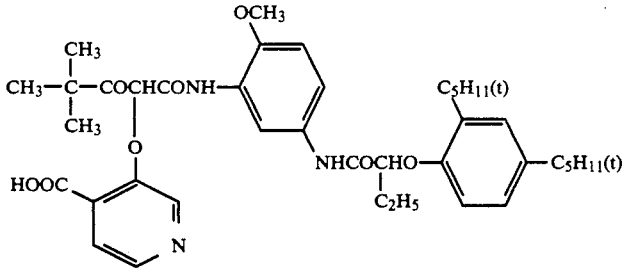
(IV-4)
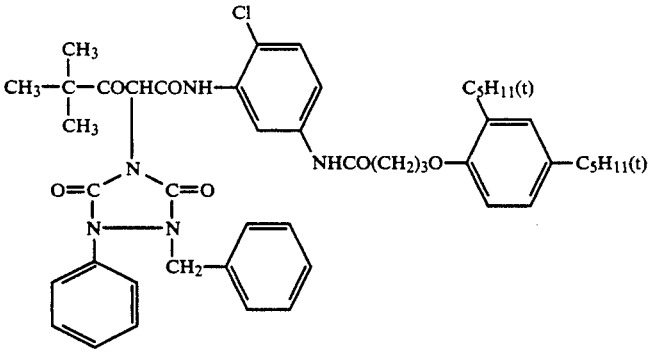
(IV-5)
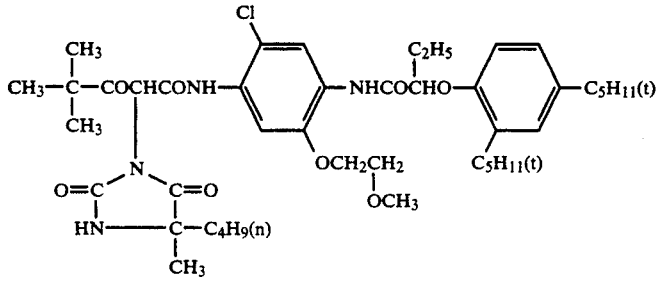

-continued
(IV-6)
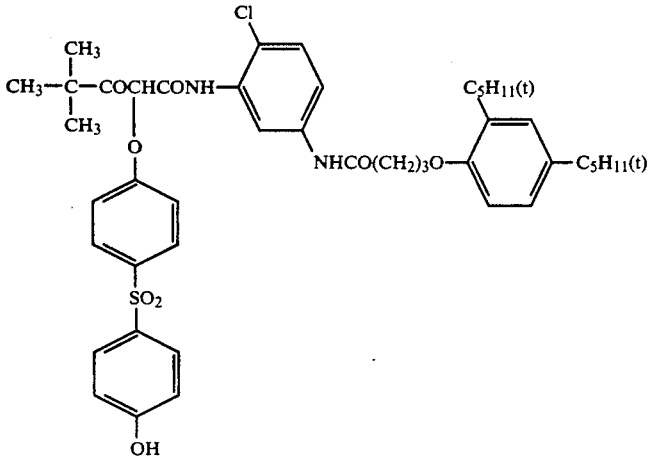
(IV-7)
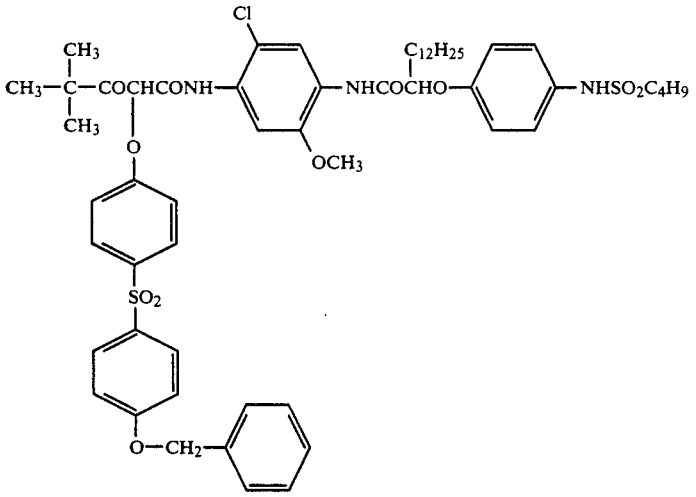
(IV-8)
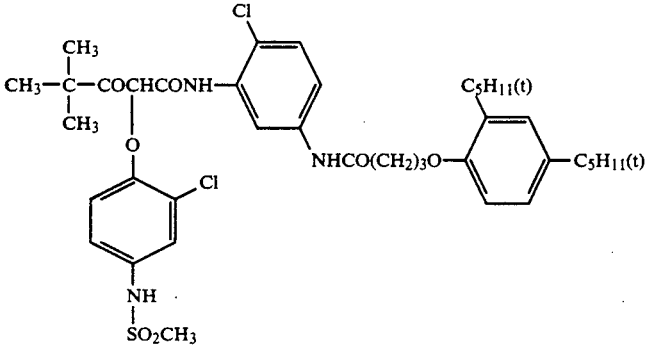

-continued
(IV-9)
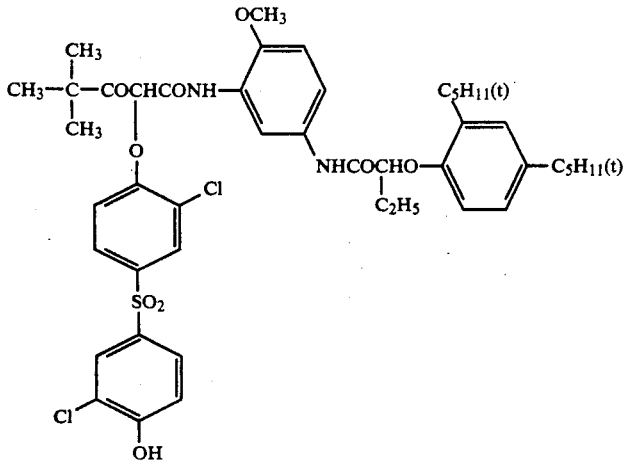
(IV-10)
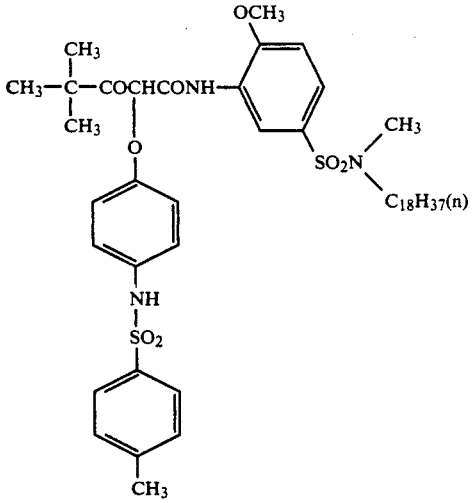
(IV-11)
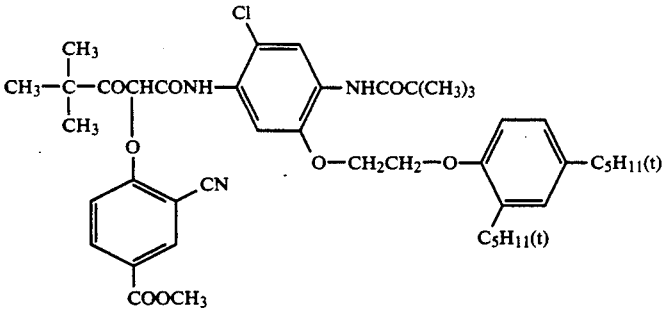
(IV-12)
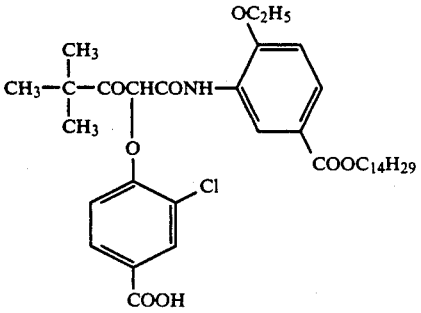

-continued
(IV-13)
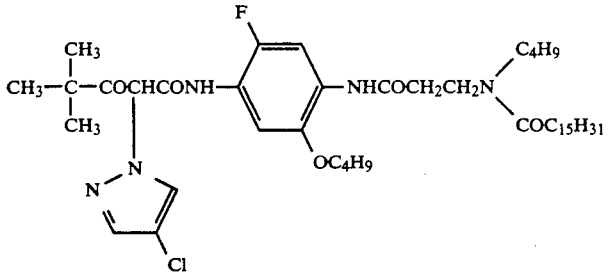
(IV-14)
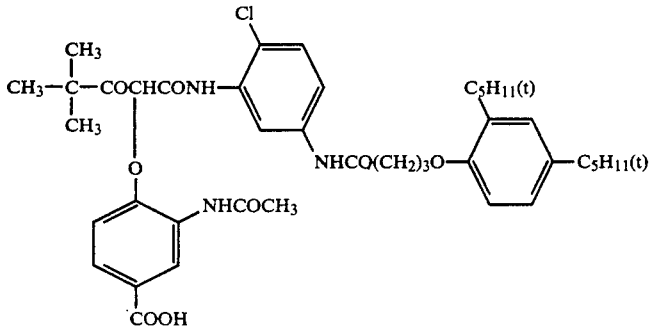
(IV-15)
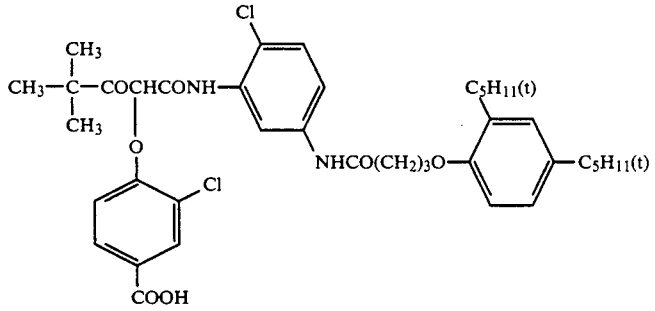
(IV-16)
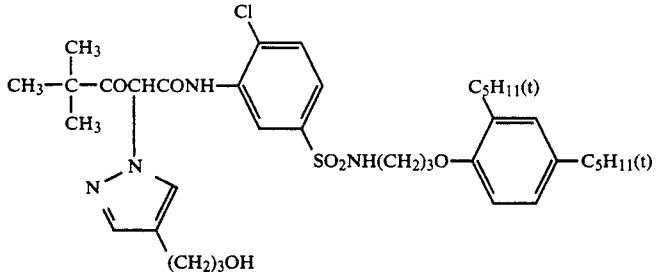
(IV-17)
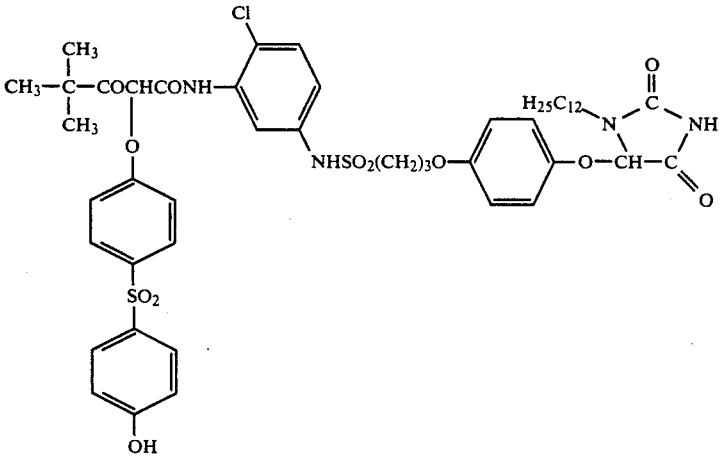

-continued
(IV-18)
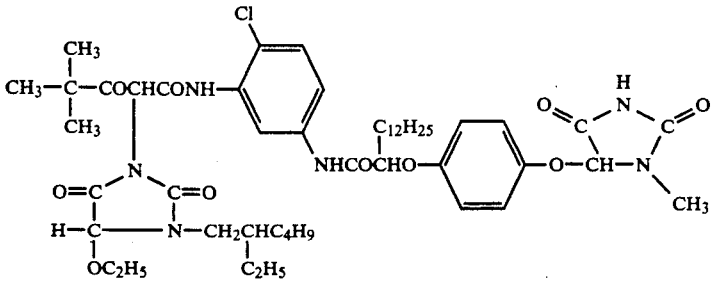
(IV-19)
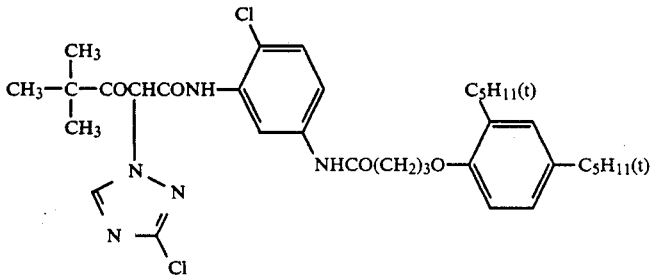
(IV-20)
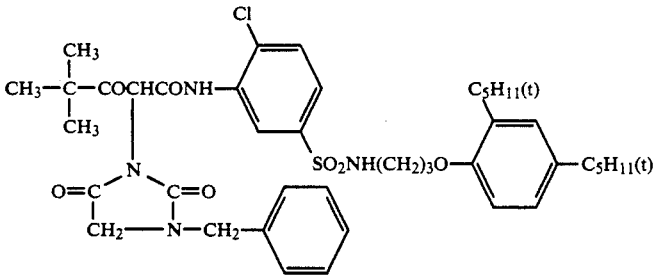
(IV-21)
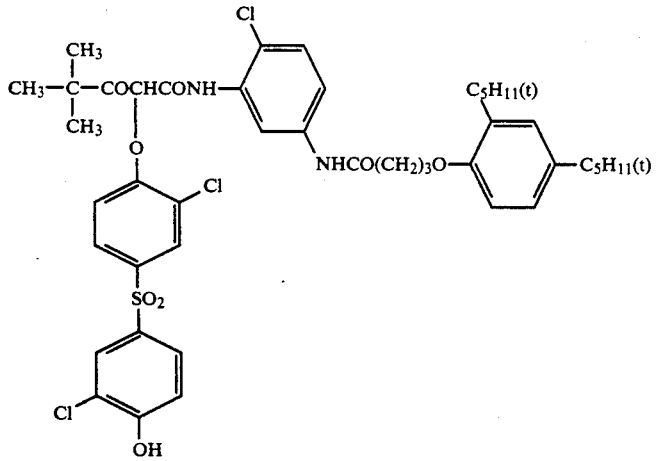
(IV-22)
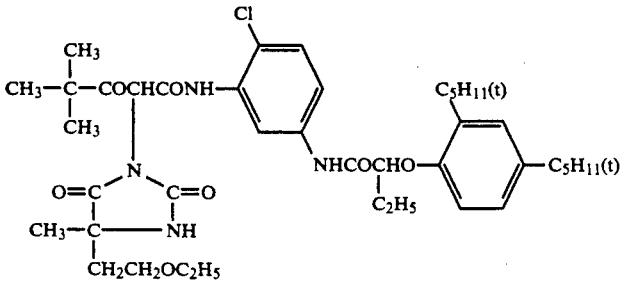

-continued
(IV-23)
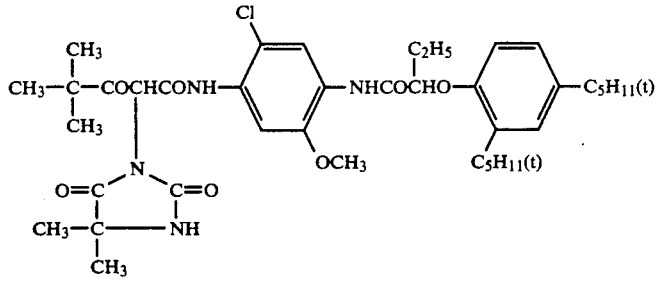
(IV-24)
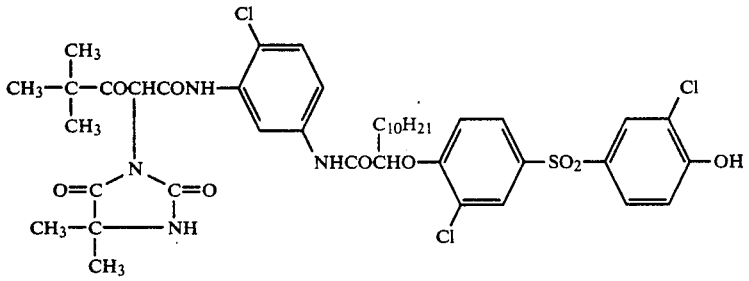
(IV-25)
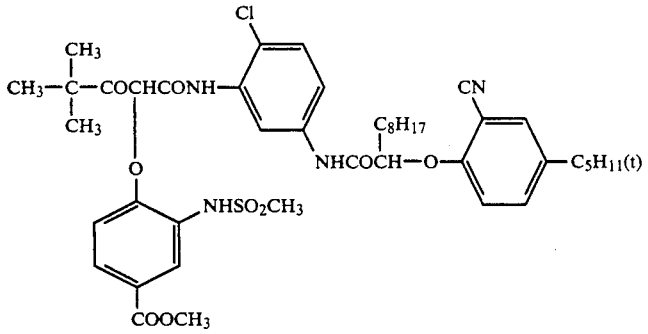
(IV-26)
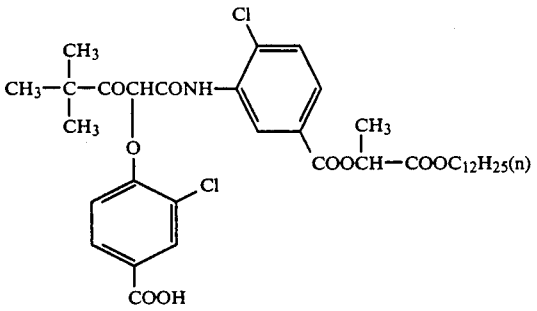
(IV-27)
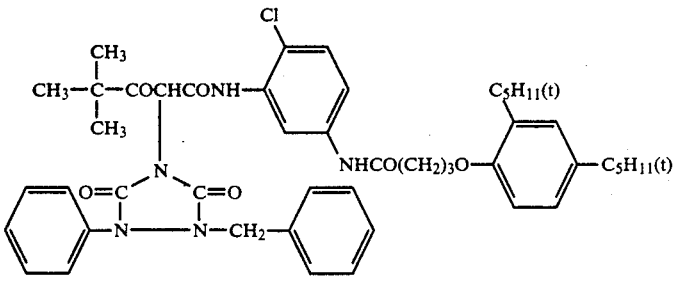

-continued
(IV-28)
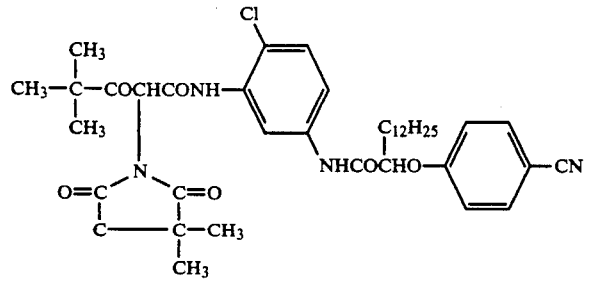
(IV-29)
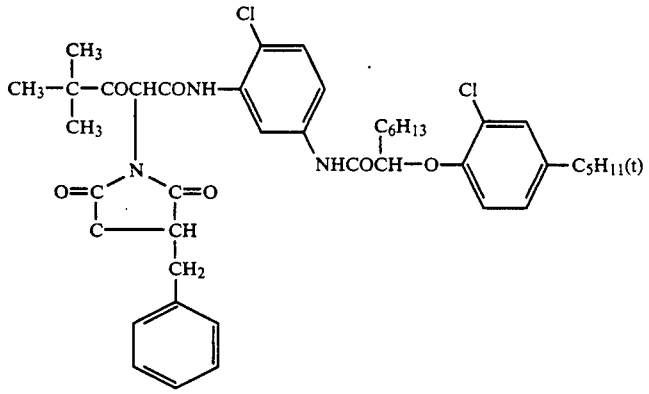
(IV-30)
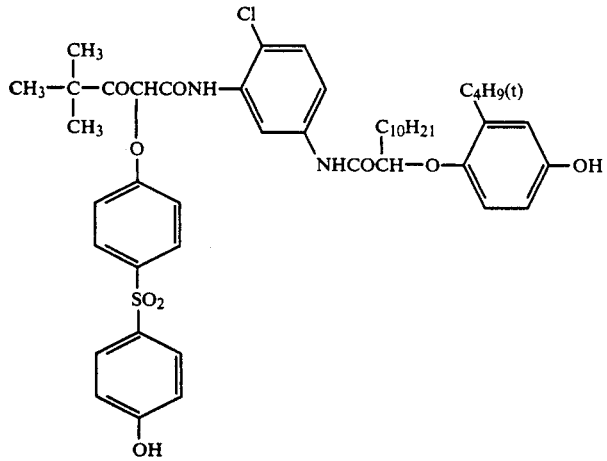
(IV-31)
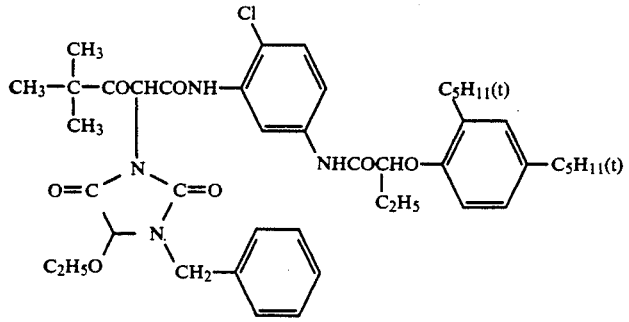

-continued (IV-32)

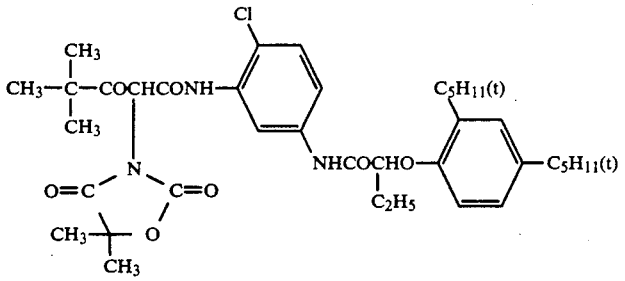

(IV-33)

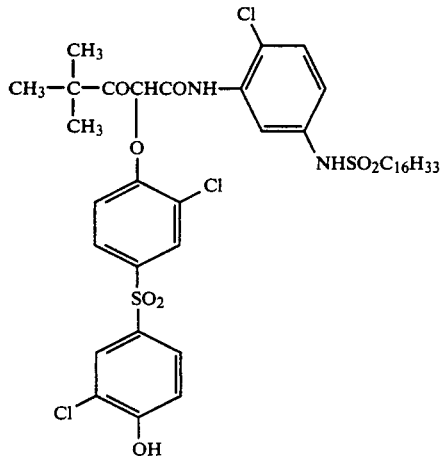

(IV-34)

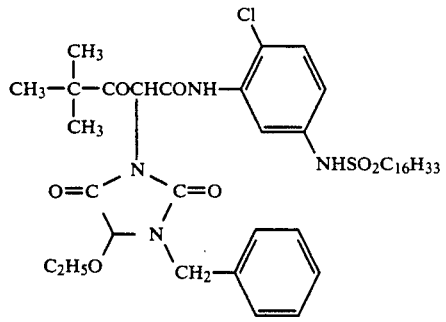

The compounds represented by general formula (B) are now described in detail.

In general formula (B) , the divalent aromatic group represented by D includes, for example, a single aromatic nucleus group, a group formed by condensing at least two aromatic nuclei or a group formed by connecting at least two aromatic nuclei directly or through an atom or an atomic group, etc. Specific examples of the divalent aromatic group include biphenyl, naphthylene, stilbene, bibenzyl, etc. In particular, those include in Groups A and B are preferred.

Group A:

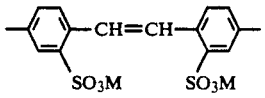

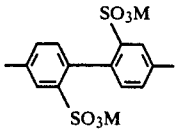

-continued

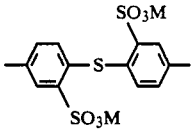

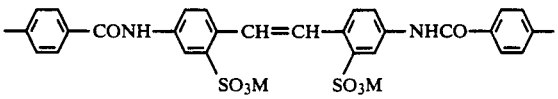

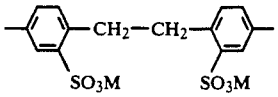

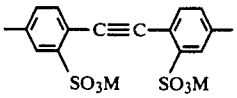

wherein M represents a hydrogen atom or a cation capable of imparting water solubility, for example, an alkali metal ion such as Na, K, etc. or an ammonium ion, etc. Group B:

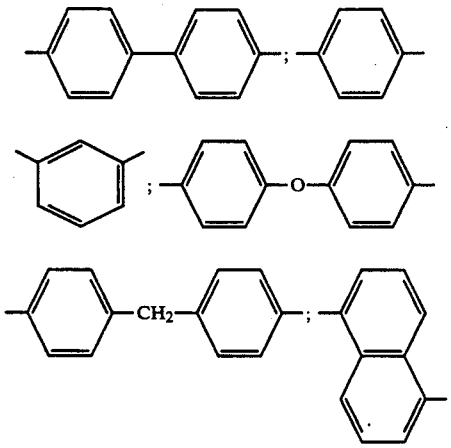

When D represents a group selected from Group B, at least one of $R_{12}$, $R_{13}$, $R_{14}$ and $R_{15}$ represents a substituent having $SO_3M$, wherein M has the same meaning as defined above.

In general formula (B), $R_{12}$, $R_{13}$, $R_{14}$ and $R_{15}$ each represents a hydrogen atom, a hydroxy group, an alkoxy group (for example, a methoxy group, an ethoxy group, etc.), an aryloxy group (for example, a phenoxy group, a naphthoxy group, an o-tolyloxy group, a p-sulfophenoxy group, etc.), a halogen atom (for example, a chlorine atom, a bromine atom, etc.), a heterocyclic group (for example, a morpholinyl group, a piperidyl group, etc.), a mercapto group, an alkylthio group (for example, a methylthio group, an ethylthio group, etc.), an. arylthio group (for example, a phenylthio group, a tolylthio group, etc.), a heterocyclic thio group (for example, a benzothiazolylthio group, a benzimidazolylthio group, a phenyltetrazolylthio group, etc.), an amino group, an alkylamino group (for example, a methylamino group, an ethylamino group, a propylamino group, a dimethylamino group, a diethylamino group, a dodecylamino group, a β-hydroxyethylamino group, a di-β-hydroxyethylamino group, a β-sulfoethylamino group, etc.), a cyclohexylamino group, an arylamino group (for example, an anilino group, an o-, m- or p-sulfoanilino group, an o-, m- or p-chloroanilino group, an o-, m- or p-anisidino group, an o-, m- or p-toluidino group, an o-, m-, p-carboxyanilino group, a hydroxyanilino group, a sulfonaphthylamino group, an o-, m- or p-aminoanilino group, an o-acetaminoanilino group, etc.), a heterocyclic amino group (for example, a 2-benzothiazolylamino group, a 2-pyridylamino group, etc.), an aralkylamino group (for example, a benzylamino group, etc.), or an aryl group (for example, a phenyl group, etc.).

Of the compounds represented by general formula (B), those wherein at least one of $R_{12}$, $R_{13}$, $R_{14}$ and $R_{15}$ is an aryloxy group, a heterocyclic thio group or a heterocycl-ic amino group are particularly preferred.

The alkyl group or moiety, aryl group or moiety and heterocyclic group or moiety described above include those substituted with one or more substituents as described with respect to $R_2$.

Typical examples of compounds represented by general formula (B) are set forth below, but the present invention should not be construed as being limited thereto.

B-1

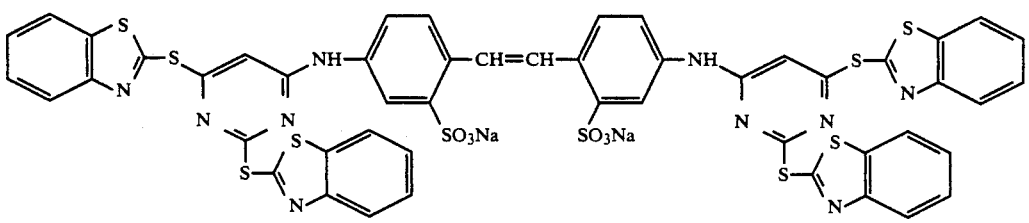

B-2

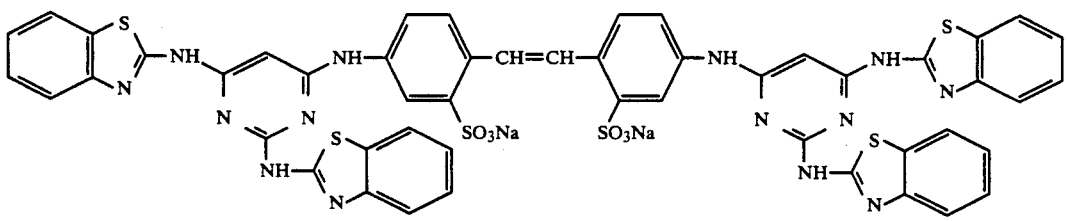

B-3

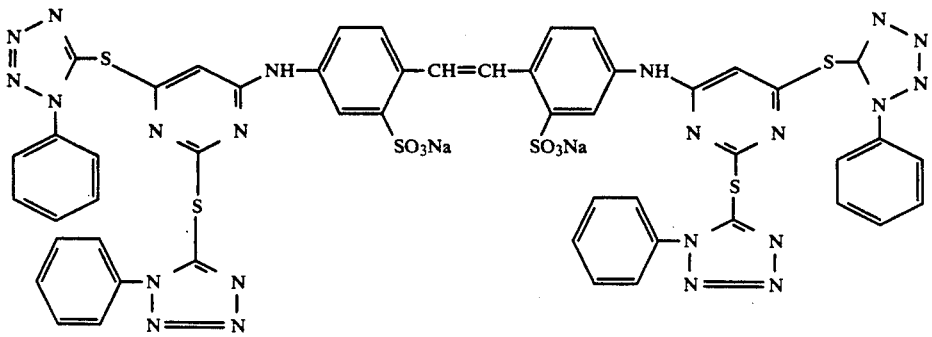

-continued
B-4
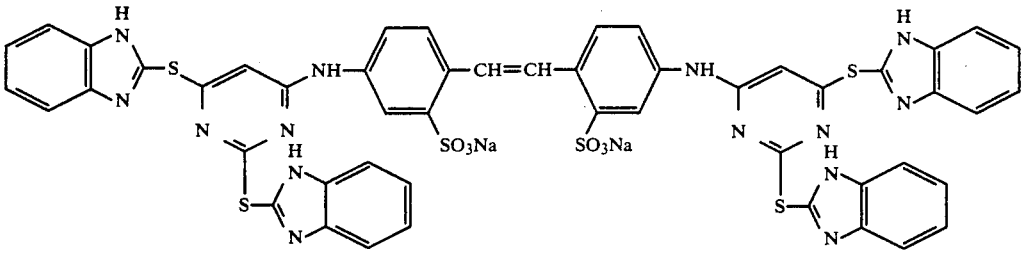
B-5
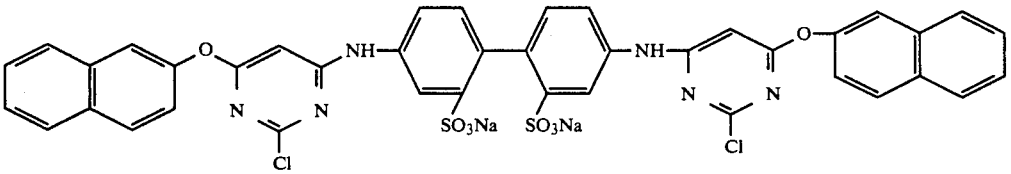
B-6
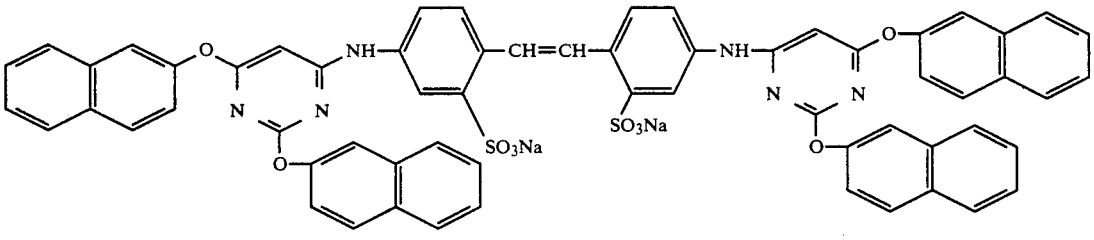
B-7
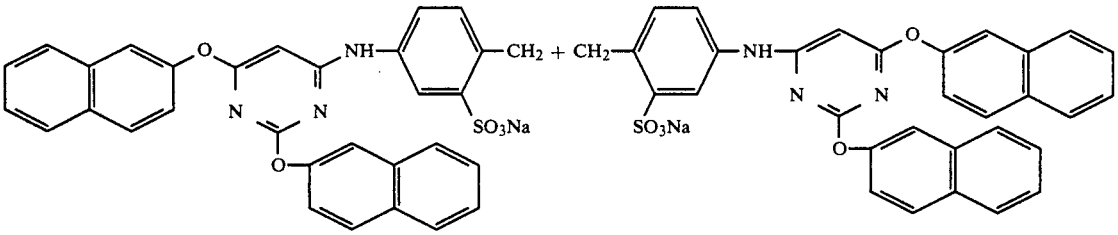
B-8
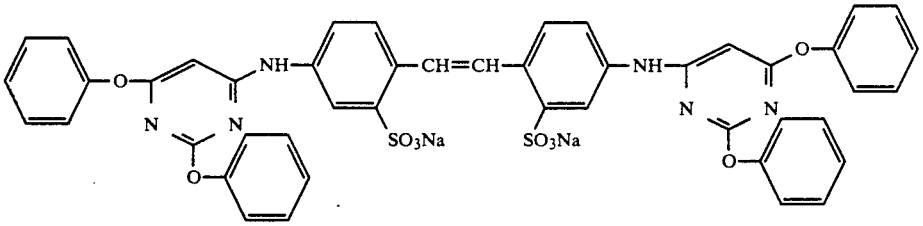
B-9
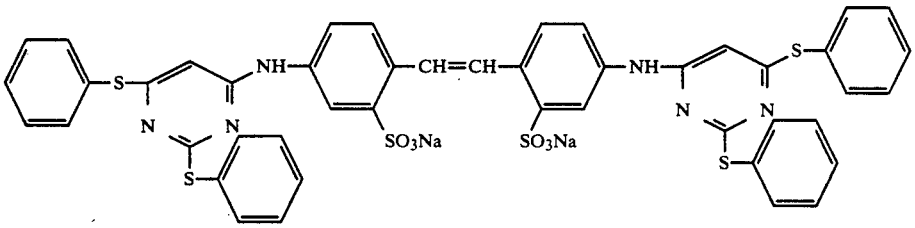
B-10
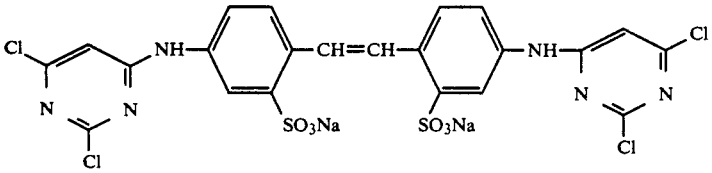

-continued

B-11

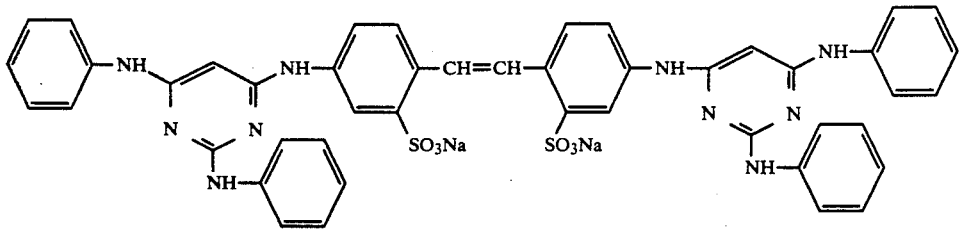

B-12

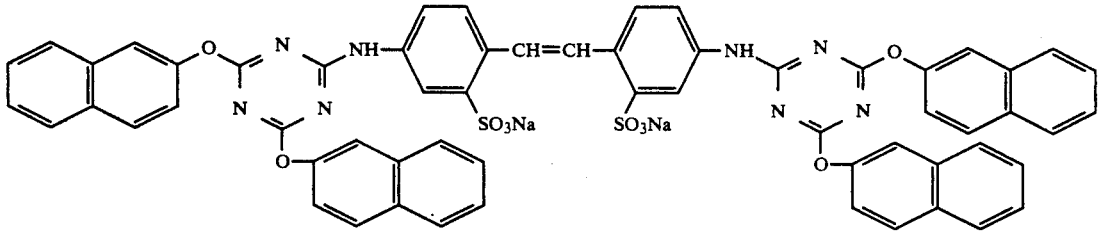

B-13

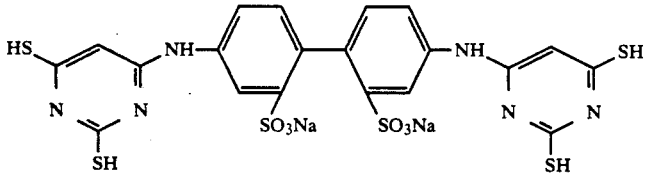

Of the specific compounds described above, Compounds B-1, B-2, B-4, B-6, B-7 and B-8 are particularly preferred.

The compounds represented by general formula (B) used in the present invention can be easily synthesized with reference to the method described in Japanese Patent Publication No. 32741/70 (which corresponds to U.S. Pat. No. 3,617,295) or in a similar manner by one ordinarily skilled in the art.

The compounds represented by general formula (B) can be added to any appropriate photographic layer which constitutes the silver halide color photographic material of the present invention in order to achieve the effect of the present invention. It is most preferred to add the compound to one or more red-sensitive silver halide emulsion layers.

The amount of the compound(s) represented by the general formula (B) added is not particularly restricted, but it is preferably from $1\times10^{-3}$ g/m$^2$ to $1\times10^{-1}$ g/m$^2$, and more preferably from $1\times10^{-3}$ g/m$^3$ $1\times10^{-2}$ g/m$^2$.

The couplers represented by general formula (I), (II) or (III) and (VI) are each incorporated into a prescribed silver halide emulsion layer in an amount of usually from 0.1 to 1.0 mol, preferably from 0.1 to 0.5 mol, per mole of silver halide in the layer. As to the proportions of the respective couplers represented by formulae (I), (II) or (III) and (IV), the molar ratios of the couplers represented by formula (II) or (III) to the couplers represented by formula (I) are 0.2/1 to 1.5/1 and the molar ratios of the couplers represented by formula (IV) to the couplers represented by formula (I) are 0.5/1 to 1.5/1, though ratios outside the ranges may be employed for designing particular photographic light-sensitive material.

In the present invention, the couplers represents by the general formulae (II) or (III) and (IV) may be added to silver halide emulsion layers by known techniques as disclosed in U.S. Pat. No. 2,322,027. Usually, they can be added according to an oil-droplet-in-water dispersion method known as an oil protected process. For example, the couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed according to the Fischer's dispersion process. The coupler dispersion may be subjected to noodle washing, ultrafiltration, or the like, to remove an organic solvent having a low boiling point and then mixed with a photographic emulsion. Moreover, at least one water-insoluble and organic solvent-soluble homopolymer or copolymer according to the present invention may be employed.

In the dispersion medium of these couplers, it is preferred to employ an organic solvent having a high boiling point which has a dielectric constant of 2 to 20 (at 25° C.) and a refractive index of 1.3 to 1.7 (at 25° C.). For example, organic solvents having a high boiling point of 160° C or above, such as alkyl phthalates (e.g., dibutyl phthalate, dioctyl phthalate, etc.), phosphates (e.g., triphenyl phosphate, tricresyl phosphate, dioctylbutyl phosphate, etc.), citrates (e.g., tributyl acetylcitrate, etc.), benzoates (e.g., octyl benzoate, etc.), fatty acid esters (e.g., dibutoxyethyl succinate, dioctyl azelate, etc.), alkylamides (e.g., diethyllaurylamide, etc.), phenols (e.g., 2,4-di-tert-amylphenol, etc.), etc., may be employed.

Into the photographic light-sensitive material of the present invention, couplers other than those represented by the above described general formulae (I), (II), (III) and (IV) can be incorporated, if desired. For instance, cyan couplers as described in U.S. Pat. Nos. 4,124,396, 4,299,914, 4,304,844, 4,327,173, 4,430,423, 4,463,086, 4,500,635, 4,532,202 and 4,557,999, Japanese Patent Application (OPI) Nos. 45249/85 and 130737/85, etc., can be employed together with the cyan coupler according to the present invention in the red-sensitive emulsion layer. Further colored magenta couplers may be incorporated into the green-sensitive emulsion layer to impart a masking effect. Moreover, development inhibitor-releasing couplers, development inhibitorreleasing hydroquinones, etc., may be used in emulsion layers of respective spectral sensitivities or in layers adjacent thereto. Development inhibitors released upon development provide interlayer effects such as improvement in image sharpness, formation of a fine-grained image, improvement in monochromatic saturation, etc.

Average diameter of oleophilic fine particles in the dispersion which is obtained by emulsifying or dispersing the solution containing at least one cyan coupler represented by the general formula (I) described above and at least one water-insoluble and organic solvent-soluble homopolymer or copolymer is preferably from 0.04 $\mu$ to 2 $\mu$, and more preferably from 0.06 $\mu$ to 0.4 $\mu$. The particle diameter can be measured by means of an apparatus, such as Nano-Sizer manufactured by Coulter Co. in England.

Couplers capable of releasing a development accelerator or a nucleating agent upon development of silver may be added to the photographic silver halide emulsion layer or layers of the present invention or layers adjacent thereto to obtain effects of improving -photographic sensitivity and graininess of color images, and to achieve a making contrasty gradation.

In the present invention, an ultraviolet light absorbing agent(s) may be added to any layer. Preferably, it is incorporated into a layer containing the coupler represented by general formula (I) or a layer adjacent thereto. Ultraviolet light absorbing agents useful in the present invention include compounds which are listed in *Research Disclosure,* No. 17643, Item VIII-C, and are preferably benzotriazole derivatives represented by the following general formula (XVII):

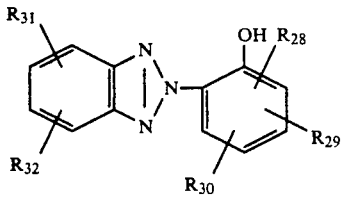

(XVII)

wherein $R_{28}$, $R_{29}$, $R_{30}$, $R_{31}$ and $R_{32}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or di-alkylamino group, an acylamino group or a 5-membered or 6-membered heterocyclic group containing an oxygen atom or a nitrogen atom, or $R_{31}$ and $R_{32}$ may be connected to each other to form a 5-membered or 6-membered aromatic ring comprising carbon atoms. Of these, those which may have a substituent or substituents may further be substituted with one or more substituents as described with respect to $R_2$.

The compounds represented by general formula (XVII) are disclosed, for example, in U.S. Pat. Nos. 4,668,611, 4,518,686, etc.

The compounds represented by the general formula (XVII) may be used alone or as a combination of two or more thereof. In addition, high molecular weight ultraviolet light absorbing agents as described in Japanese Patent Application (OPI) Nos. 111942/83, 178351/83, 181041/83, 19945/84 and 23344/84 can also be employed. The low molecular weight ultraviolet light absorbing agent and the high molecular weight ultraviolet light absorbing agent may be used in combination. Compounds which are liquid at an ordinary temperature are preferably used alone or in combination.

Combined use of the ultraviolet light absorbing agent(s) represented by general formula (XVII) with the combination of the couplers according to the present invention serves to improve the preservability, particularly light fastness, of the dye images formed, especially cyan images. The ultraviolet light absorbing agents may be coemulsified with the cyan coupler.

As to the amount of the ultraviolet light absorbing agent, it is sufficient to add it in an amount to impart to the cyan dye image stability against light but, when used in an excess amount, it sometimes causes yellowing of unexposed areas (white background) of the color photographic material. Therefore, ordinarily, the amount is preferably selected in a range between $1\times10^{-4}$ mol/m$^2$ and $2\times10^{-3}$ mol/m$^2$, particularly $5\times10^{-4}$ mol/m$^2$ to $1.5\times10^{-3}$ mol/m$^2$ of the support.

In the light-sensitive stratum structure of a conventional color paper, the ultraviolet light absorbing agent is incorporated into at least one (preferably both) layers adjacent a cyan coupler-containing red-sensitive emulsion layer. In the case of adding the ultraviolet light absorbing agent to an intermediate layer between a green-sensitive layer and a red-sensitive layer, it may be coemulsified with a color mixing preventing agent. Where the ultraviolet light absorbing agent is added to a protective layer, another protective layer may be provided as an outermost layer. A matting agent with a conventional particle size, or the like may be incorporated into this protective layer. These concepts also apply to the present invention.

In order to improve the preservability of the dye images formed, particularly the yellow and magenta images, various compounds can be employed as color fading preventing agents together with the couplers according to the present invention. Suitable examples of such compounds include those described in the patents cited in *Research Disclosure,* No. 17643, Items IV-1 I to IV-J, *Research Disclosure*, No. 15162, British Patents 1,326,889, 1,354,313 and 1,410,846, U.S. Pat. Nos. 3,361,135 and 4,268,593, Japanese Patent Publication Nos. 1420/76 and 6623/77, Japanese Patent Application (OPI) Nos. 114036/83 and 5246/84, U.S. Pat. Nos. 3,432,300, 3,573,050, 3,574,627, 3,764,337, 3,935,016, 3,982,944, 4,254,216 and 4,279,990; British Patents 1,347,556, 2,062,888, 2,066,975 and 2,077,455; Japanese Patent Application (OPI) Nos. 152225/77, 17729/78, 20327/78, 145530/79, 6321/80, 21004/80, 24141/83, 10539/84 and 97353/85; Japanese Patent Publication Nos. 31625/73 and 12337/79, etc. These color fading preventing agents may be co-emulsified with the yellow coupler or the magenta coupler.

In order to prevent color fading, for example, the techniques described in Japanese Patent Application (OPI) Nos. 11330/74, 57223/75 and 85747/81 can be applied to the present invention.

Various silver halides may be used in the silver halide emulsion layer according to the present invention. For example, there are illustrated silver chloride, silver bromide, silver chlorobromide, silver iodobromide, silver chloroiodobromide, etc.

With respect to the halogen composition of the silver halide, there is no particular limitation and it can be appropriately selected depending on the purpose of use. In the case of color paper subjected to a rapid processing, silver chlorobromide containing 10 mol% or less silver bromide is particularly preferred. Silver halide grains are not limited as to crystal form, crystal structure, grain size, grain size distribution, etc. Crystals of silver halide may be either normal crystal or twin crystal, and may have any of cubic, octahedral, and tetradecahedral structure. In addition, tabular grains having a thickness of 0.5 μm or less, a diameter of at least 0.6 μm, and an average aspect ratio of 5 or more, as described, for example, in *Research Disclosure,* No. 22534, may be used.

Crystal structure may be uniform or of a structure wherein the inner portion and the outer portion are different from each other in composition, or may be a stratified structure. Further, silver halide crystals different from each other in composition may be connected by an epitaxial junction(s) or the silver halide crystals may comprise a mixture of grains of various crystal forms. In addition, silver halide grains of the type forming a latent image mainly on the surface thereof and grains of the type forming a latent image mainly in the interior thereof may be used.

As to the grain size of silver halide grains, fine grains having a grain size of not more than 0.1 μ and large size grains having a grain size of up to 3 μ in diameter (projected area) may be used. A monodisperse emulsion having a narrow grain size distribution and a polydisperse emulsion having a broad distribution may be used. A monodisperse emulsion having a coefficient of variation of 0.15 or less is preferred.

These silver halide grains may be prepared according to known processes conventionally employed in the art.

The above described silver halide emulsions may be sensitized by ordinarily employed chemical sensitization process, i.e., sulfur sensitization process, noble metal sensitization process, or a combination thereof.

As a support to be used in the present invention, any of a transparent support, such as polyethylene terephthalate and cellulose triacetate, etc., and a reflective support, as described hereinafter, may be used, with the latter reflective support being preferable. As reflective supports, there are illustrated, for example, baryta paper, polyethylene-coated paper, polypropylene synthetic paper, vinyl chloride resin containing a white pigment, transparent supports having provided thereon a reflective layer or having a reflective substance, such as a glass sheet, a polyester film (e.g., polyethylene terephthalate, cellulose triacetate or cellulose nitrate, etc.), a polyamide film, a polycarbonate film, a polystyrene film, etc. These supports may appropriately be selected depending upon the purpose of use.

The blue-sensitive emulsion, green-sensitive emulsion and red-sensitive emulsion used in the present invention are those spectrally sensitized so as to have color sensitivities using spectral sensitizing dyes. Examples of dyes which can be used include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

Dyes which do not themselves have a spectral sensitizing function but which exhibit supersensitization or substances which do not substantially absorb visible light but which exhibit supersensitization may be incorporated into emulsions in combination with the sensitizing dye.

In the color photographic light-sensitive material of the present invention, a subsidiary layer such as a subbing layer, an intermediate layer and a protective layer, etc., can be provided in addition to the above-described constituting layers.

Gelatin is advantageously used as a binder or protective colloid for photographic emulsions herein, but other hydrophilic colloids can also be used.

As gelatin, not only lime processed gelatin but also acid processed gelatin, deliming gelatin and enzyme processed gelatin as described in *Bull. Soc. Sci. Phot. Japan,* 16, page 30 (1966) may be used. Further, hydrolyzed products or enzymatic decomposition products of gelatin can also be used.

The photographic light-sensitive material of the present invention may contain hydroquinone derivatives, aminophenol derivatives, gallic acid derivatives, ascorbic acid derivatives, etc., as color fog preventing agents. Specific examples thereof used are described in U.S. Pat. Nos. 2,360,290, 2,336,327, 2,418,613, 2,675,314, 2,701,197, 2,704,713, 2,728,659, 2,732,300 and 2,735,765; Japanese Patent Application (OPI) Nos. 92988/75, 92989/75, 93928/75, 110337/75 and 146235/77; Japanese Patent Publication No. 23813/75, etc.

To the color photographic light-sensitive material of the present invention, various photographic additives known in this field, for example, stabilizers, antifogging agents, surface active agents, couplers other than those of the present invention, filter dyes, irradiation preventing dyes, developing agents, etc., can be added in addition to the above described compounds, if desired.

Dyes formed are degradated not only with light, heat or humidity but also by mold during preservation. Since cyan color images are particularly degradated by mold, it is preferred to employ antimolds. Specific examples of antimolds used include 2-thiazolylbenzimidazoles as described in Japanese Patent Application (OPI) No. 157244/82. Antimolds can be incorporated into the photographic light-sensitive material or may be added thereto from outside during development processing. Antimolds can be introduced into photographic materials in any appropriate steps so long as the photographic materials after development processing contain them.

In accordance with the present invention, a multilayer silver halide color photographic material which has good color forming property and forms a color photographic image with improved preservability and particularly of no change in color balance when preserved in a dark place or exposed to light for a long period of time, and in addition, which is highly sensitive and exhibits less change in sensitivity with the lapse of time, can be provided.

The present invention will be explained in greater detail with reference to the following examples, but the present invention should not be construed as being limited thereto. The percentages hereafter are by weight unless otherwise indicated.

EXAMPLE 1

On a paper support, both surfaces of which were laminated with polyethylene, were coated layers as shown below in order to prepare a multilayer color printing paper. The coating solutions were prepared in the following manner. *Preparation of Coating Solution for First Layer:*

19.1 g of Yellow Coupler (IV-34) and 4.40 g of Color Fading Preventing Agent (Cpd-1) were dissolved in a mixture of 27.2 ml of ethyl acetate and 7.7 ml of a solvent (Solvent) and the resulting solution was emulsified or dispersed in 185 ml of a 10% aqueous solution of lime processed gelatin containing 8 ml of a 10% aqueous solution of sodium dodecylbenzenesulfonate. Separately, to a silver chlorobromide emulsion (having a bromide content of 80.0 mol% and containing 70 g of silver per Kg of the emulsion - Silver Halide emulsion (1) formed as later described) was added $5.0\times10^{-4}$ mol of a blue-sensitive sensitizing dye shown below per mol of silver to prepare a blue-sensitive emulsion. The above described emulsified dispersion was mixed with the blue-sensitive silver chlorobromide emulsion, with the concentration of the resulting mixture being controlled, to form the composition shown below, i.e., the coating solution for the first layer.

Coating solutions for the second layer to the seventh layer were prepared in a similar manner as described for the coating solution for the first layer 1-Oxy-3,5-dichloro-S-triazine sodium salt was used as a gelatin hardener in each layer.

The following spectral sensitizing dyes were employed in the emulsion layers, respectively.

Blue-Sensitive Emulsation Layer:

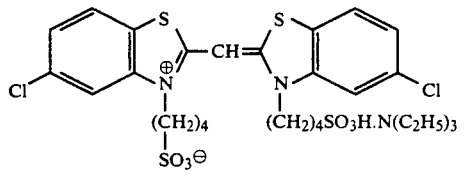

(Amount added : $5.0\times10^{\times4}$ mol per mol of silver halide).

Green-Sensitive Emulsion Layer

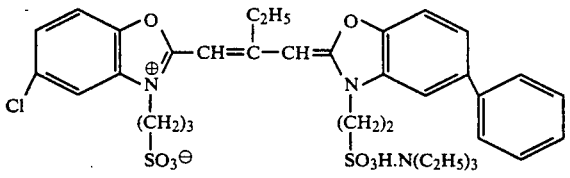

(Amount added: $4.0\times10^{\times4}$ mol per mol of silver halide).

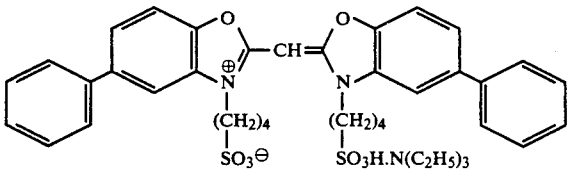

(Amount added: $7.0\times10^{\times5}$ mol per mol of silver halide).

Red-Sensitive Emulsion Layer

| | |
|---|---|
| Solution 1 | |
| $H_2O$ | 1,000 ml |
| NaCl | 5.5 g |
| Lime processed Gelatin | 25 g |
| Solution 2 | |
| Sulfuric acid (1N) | 20 ml |
| Solution 3 | |
| A compound (1%) of the formula: | 2 ml |

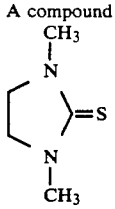

| | |
|---|---|
| Solution 4 | |
| KBr | 2.80 g |
| NaCl | 0.34 g |
| $H_2O$ to make | 140 ml |
| Solution 5 | |
| $AgNO_3$ | 5 g |
| $H_2O$ to make | 140 ml |
| Solution 6 | |
| KBr | 67.20 g |
| NaCl | 8.26 g |
| $K_2IrCl_6$ (0.001%) | 0.7 ml |
| $H_2O$ to make | 320 ml |
| Solution 7 | |
| $AgNO_3$ | 120 g |
| $NH_4NO_3$ (50%) | 2 ml |
| $H_2O$ to make | 320 ml |

(Amount added: $0.9\times10^{\times4}$ mol per mol of silver halide).

Silver halide emulsion (1) used inthe Examples was prepared in the following manner.

| | |
|---|---|
| Solution 1 | |
| $H_2O$ | 1,000 ml |
| NaCl | 5.5 g |
| Lime processed Gelatin | 25 g |
| Solution 2 | |
| Sulfuric acid (1N) | 20 ml |
| Solution 3 | |
| A compound (1%) of the formula: | 2 ml |

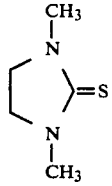

| | |
|---|---|
| Solution 4 | |
| KBr | 2.80 g |
| NaCl | 0.34 g |
| $H_2O$ to make | 140 ml |
| Solution 5 | |
| $AgNO_3$ | 5 g |
| $H_2O$ to make | 140 ml |
| Solution 6 | |
| KBr | 67.20 g |
| NaCl | 8.26 g |
| $K_2IrCl_6$ (0.001%) | 0.7 ml |
| $H_2O$ to make | 320 ml |
| Solution 7 | |
| $AgNO_3$ | 120 g |
| $NH_4NO_3$ (50%) | 2 ml |
| $H_2O$ to make | 320 ml |

Solution 1 was heated at 75° C., Solution 2 and Solution 3 were added thereto and then Solution 4 and Solution 5 were added simultaneously over a period of 9 minutes thereto. After 10 minutes, Solution 6 and Solution 7 were added simultaneously over a period of 45 minutes. After 5 minutes, the temperature was dropped and the mixture was desalted. Water and lime processed gelatin for dispersion were added thereto and the pH was adjusted to 6.2, whereby a monodisperse cubic silver chlorobromide emulsion (having an average grain size of 1.01 μm, a coefficient of variation [a value obtained by dividing the standard statistical deviation by the average grain size: S/d]of 0.08 and a silver bromide content of 80 mol%) was obtained. The emulsion was subjected to optimum chemical sensitization using sodium thiosulfate.

Silver halide emulsions (2) and (3) used in the green-sensitive emulsion layer and red-sensitive emulsion layer, respectively, were prepared in the same manner as described above except changing the amounts of chemicals, temperature and time.

Silver halide emulsion (2) was a monodisperse cubic silver chlorobromide emulsion having a grain size of 0.45 μm, a coefficient of variation of 0.07 and a silver bromide content of 75 mol%, and Silver halide emulsion (3) was a monodisperse cubic silver chlorobromide emulsion having a grain size of 0.51 μm, a coefficient of variation of 0.07 and a silver bromide content of 70 mol%.

To the blue-sensitive emulsion layer, green-sensitive emulsion layer and red-sensitive emulsion layer, was added 1-(5-methylureidophenyl)-5-mercaptotetrazole in amounts of $4.0\times10^{\times6}$ mol, $3.0\times10^{\times5}$ mol and $1.0\times10^{\times5}$ mol per mol of silver halide, respectively.

Further, to the blue-sensitive emulsion layer and green-sensitive emulsion layer, was added 4-hydroxy-6-methyl-1,3,3*a*,7-tetraazaindene in amounts of $1.2\times10^{-2}$ mol and $1.1\times10^{-2}$ mol per mol of silver halide, respectively.

Moreover, in order to prevent irradiation, the following dyes were added the emulsion layers.

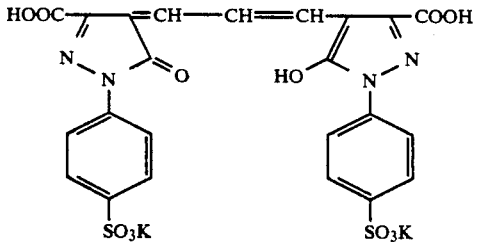

and

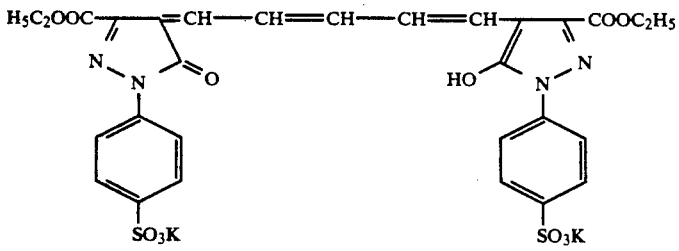

Layer Construction

The composition of each layer is shown below. The numerical values denote coating amounts of components in the unit of g/m² of the support. The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver Halide Emulsion (1) | 0.26 |
| | Lime processed Gelatin | 1.83 |
| | Yellow Coupler (IV-34) | 0.83 |
| | Color Image Stabilizer (Cpd-1) | 0.19 |
| | Solvent (Solv-1) | 0.35 |
| Second Layer (Color mixing preventing layer) | Lime processed Gelatin | 0.99 |
| | Color Mixing Preventing Agent (Cpd-2) | 0.08 |
| Third Layer (Green-sensitive layer) | Silver Halide Emulsion (2) | 0.16 |
| | Lime processed Gelatin | 1.79 |
| | Magenta Coupler (III-19) | 0.32 |
| | Color Image Stabilizer (Cpd-3) | 0.19 |
| | Anti-Staining Agent (Cpd-4) | 0.02 |
| | Anti-Staining Agent (Cpd-5) | 0.03 |
| | Solvent (Solv-2) | 0.65 |
| Fourth Layer (Ultraviolet light absorbing layer) | Lime processed Gelatin | 1.58 |
| | Color Mixing Preventing Agent (Cpd-6) | 0.05 |
| | Ultraviolet Absorbing Agent (UV-1) | 0.62 |
| | Solvent (Solv-3) | 0.24 |
| Fifth Layer (Red-sensitive layer) | Silver Halide Emulsion (3) | 0.23 |
| | Lime processed Gelatin | 1.34 |
| | Cyan Coupler (I-1) | 0.33 |
| | Color Image Stabilizer (Cpd-7) | 0.17 |
| | Solvent (Solv-4) | 0.23 |
| Sixth Layer (Ultraviolet absorbing layer) | Lime processed Gelatin | 0.53 |
| | Ultraviolet Absorbing Agent (UV-1) | 0.21 |
| | Solvent (Solv-3) | 0.08 |
| Seventh Layer (Protective layer) | Acid processed Gelatin | 1.33 |
| | Acryl-modified Polyvinyl Alcohol Copolymer (degree of modification: 17%) | 0.17 |
| | Liquid Paraffin | 0.03 |

The compounds used inthe earlier-described layers have the structures shown below.

Color Image Stabilizer (Cpd-1)

-continued
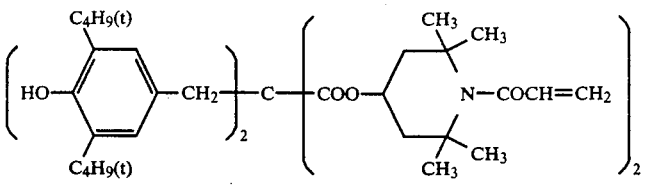
Color Mixing Preventing Agent (Cpd-2)
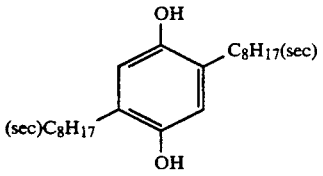
Color Image Stabilizer (Cpd-3)
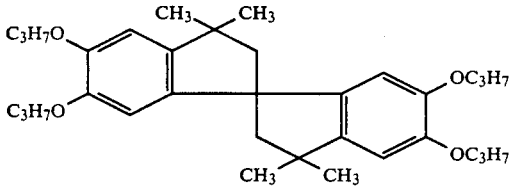
Anti-Staining Agent (Cpd-4)
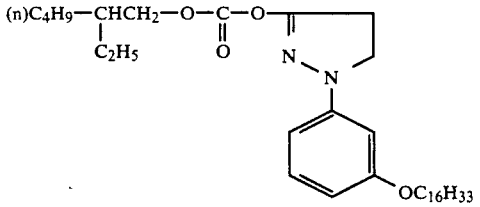
Anti-Staining Agent (Cpd-5)
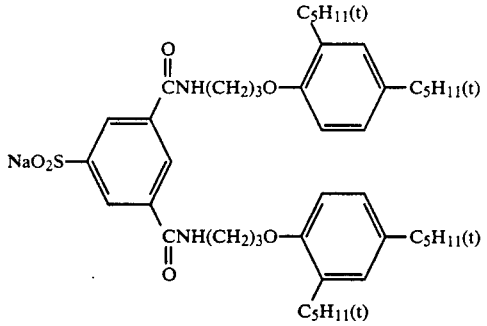
Color Mixing Preventing Agent (Cpd-6)
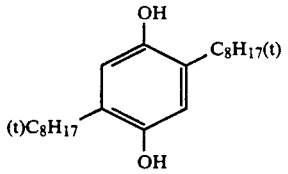
Color Image Stablilizer (Cpd-7)
A mixture of
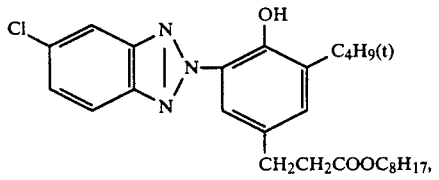
(a)

-continued
(b)
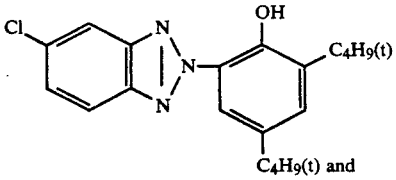
(c)
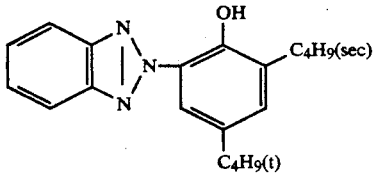
in a weight ratio of 5:8:9 as (a)/(b)/(c); same hereafter.
Ultraviolet Absorbing Agent (UV-1):
A mixture of
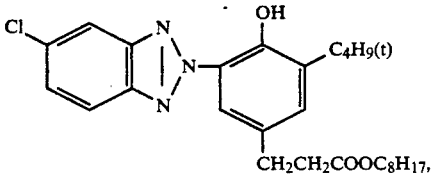
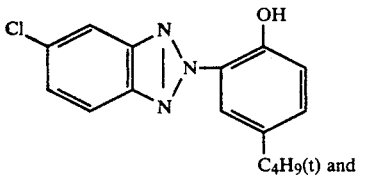
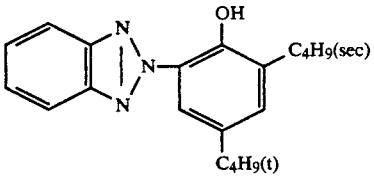
in a weight ratio of 2:9:8.
Solvent (Solv-1):
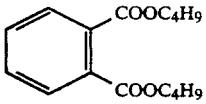
Solvent (Solv-2):
A Mixture of
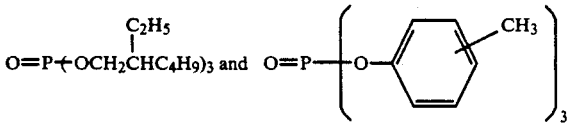
in a volume ratio of 2:1.
Solvent (Solv-3):
$O{=}P{\leftarrow}O{-}C_9H_{19}(iso))_3$
Solvent (Solv-4):
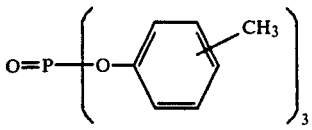
In the same manner as described for the layer construction of Sample No. 1 above, Sample Nos. 2 to 7

TABLE 1

| Sample No. | Cyan Coupler | | Polymer | | Solvent | Compound of General Formula (B) |
|---|---|---|---|---|---|---|
| 1 | I-1 | 0.33 | — | | 0.23 | — |
| 2 | I-14 | 0.34 | — | | 0.23 | — |
| 3 | I-1 | 0.33 | P-3 | 0.50 | — | — |
| 4 | I-1 | 0.33 | P-3 | 0.50 | — | B-6 $6 \times 10^{-3}$ |
| 5 | I-14 | 0.34 | P-57 | 0.40 | — | — |
| 6 | I-14 | 0.34 | P-57 | 0.40 | — | B-6 $6 \times 10^{-3}$ |
| 7 | I-21 | 0.20 | P-57 | 0.40 | — | B-6 $6 \times 10^{-3}$ |

In Table 1, the numerical values following the compounds denote the coating amounts of the compounds in units of $g/m^2$. The solvent used was Solv-4.

Sample Nos. 1 to 7 were wedgewise exposed for sensitometry through a three-color separation filter using a sensitometer (FWH type manufactured by Fuji Photo Film Co., Ltd.) equipped with a light source of 3200° K. The amount of exposure was 250 CMS for an exposure time of 0.1 second. Then, the samples were subjected to development processing according to the following processing steps.

| Processing Step | Temperature | Time |
|---|---|---|
| Color Development | 33° C. | 3 min 30 sec |
| Bleach-Fixing | 33° C. | 1 min 30 sec |
| Washing with Water | 24 to 34° C. | 3 min |
| Drying | 70 to 80° C. | 1 min |

The composition of each processing solution used was as follows.

| | |
|---|---|
| Color Developing Solution: | |
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.0 g |
| Hydroxylamine sulfate | 4.0 g |
| Brightening agent (WHITEX 4B manufactured by Sumitomo Chemical Co., Ltd.) | 1.0 g |
| Water to make | 1000 ml |
| pH (25° C.) | 10.20 |
| Bleach-Fixing Solution: | |
| Water | 400 ml |
| Ammonium thiosulfate (70%) | 150 ml |
| Sodium sulfite | 18 g |
| Ammonium ethylenediamine-tetraacetato ferrate | 55 g |
| Disodium ethylenediaminetetraacetate | 5 g |

-continued

| | |
|---|---|
| Water to make | 1000 ml |
| pH (25° C.) | 6.70 |

These samples thus processed were subjected to tests with respect to color image fastness. Specifically, for fastness after being preserved at 100° C. in the dark for 5 days, fastness after being preserved at 60° C. and 70% RH in the dark for 4 months, and fastness after being exposed to light in a Xenon tester (100,000 lux) for 14 days, and rates of decrease in density at an area having an initial density of 1.0 were measured. The results obtained are shown in Table 2.

Further, the relative sensitivity of the red-sensitive emulsion layer and the decrease in sensitivity with the lapse of time (under condition of 40° C. and 80% RH for 2 days) were evaluated. The sensitivity was shown by a reciprocal of the exposure amount required for obtaining a density of fog +0.5 and the sensitivity of Sample No. 1 was taken as 100 and the other sensitivities were shown relatively. The decrease in sensitivity was shown in the same manner.

TABLE 2

| | Color Image Fastness | | | | | | | | | Red-Sensitive Layer | |
|---|---|---|---|---|---|---|---|---|---|---|---|
| | 100° C., 5D | | | 60° C., 70%, 4M | | | Xenon, 14D | | | Relative | Decrease in |
| Sample No. | Y | M | C | Y | M | C | Y | M | C | Sensitivity | Sensitivity |
| 1 (Comparison) | 99 | 98 | 60 | 98 | 99 | 60 | 86 | 84 | 72 | 100 | 72 |
| 2 (Comparison) | 99 | 98 | 80 | 98 | 99 | 85 | 86 | 84 | 70 | 95 | 71 |
| 3 (Comparison) | 99 | 98 | 93 | 98 | 99 | 93 | 86 | 84 | 82 | 78 | 53 |
| 4 (Present Invention) | 99 | 98 | 93 | 98 | 99 | 93 | 86 | 84 | 82 | 115 | 106 |
| 5 (Comparison) | 99 | 98 | 95 | 98 | 99 | 96 | 86 | 84 | 85 | 80 | 57 |
| 6 (Present Invention) | 99 | 98 | 95 | 98 | 99 | 96 | 86 | 84 | 85 | 119 | 111 |
| 7 (Present Invention) | 99 | 98 | 95 | 98 | 99 | 96 | 86 | 84 | 86 | 125 | 118 |

Y, M and C denote yellow color image, magenta color image and cyan color image, respectively.

From the results shown in Table 2, it can be seen that improved image preservability and no change in color balance for a long period of time were achieved by dispersing the cyan coupler according to the present invention using the water-insoluble and organic solvent soluble polymer composed of at least one repeating unit which does not have an acid group in the main chain or side chain thereof and employing the combination of the specific yellow coupler and magenta coupler. See a comparison of Sample Nos. 1 and 2 with Sample Nos. 3 and 5, respectively. It is also apparent, however, that Sample Nos. 3 and 5 exhibit low sensitivity of the red-sensitive emulsion layer and showed a severe decrease in sensitivity with the lapse of time.

On the contrary, Sample Nos. 4, 6 and 7 each containing the compound represented by the general formula (B) according to the present invention exhibited a remarkable improvement in the low sensitivity and a decrease in sensitivity with the lapse of the time (problems in Sample Nos. 3 and 5) while maintaining the described good image preservability.

EXAMPLE 2

The composition of the third layer (green-sensitive layer) in Example 1 was changed to as follows.

| | | |
|---|---|---|
| Third Layer (Green-sensitive | Silver Halide Emulsion (2) | 0.19 |
| | Lime processed Gelatin | 1.23 |

-continued

| | | |
|---|---|---|
| layer) | Magenta Coupler (II-13) | 0.28 |
| | Color Image Stabilizer (Cpd-3) | 0.09 |
| | Anti-Staining Agent (Cpd-8) | 0.06 |
| | Solvent (Solv-5) | 0.27 |
| | Solvent (Solv-6) | 0.15 |

The compounds used above have the structures now shown.

Color Image Stabilizer (Cpd-8):

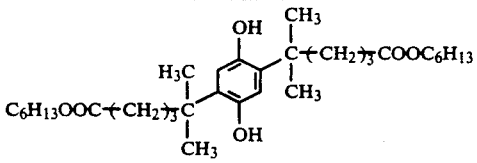

Solvent (Solv-5):

A mixture of

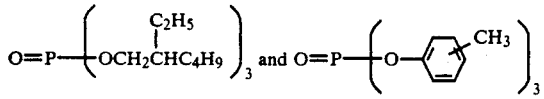

in a volume ratio of 1:2.

Solvent (Solv-6):

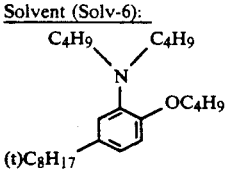

In the same manner as described in Example 1, Sample Nos. 8 to 13 were prepared except for changing the kinds and amounts of he cyan coupler, solvent, water-insoluble and organic solvent-soluble polymer according to the present invention and the compound represented by the general formula (B) used in the fifth layer (read-sensitive layer) to those described in Table 3 below.

TABLE 3

| Sample No. | Cyan Coupler | | Polymer | | Solvent | Compound of General Formula (B) |
|---|---|---|---|---|---|---|
| 8 | I-1 | 0.33 | — | | 0.23 | — |
| 9 | I-14 | 0.34 | — | | 0.23 | — |
| 10 | I-1 | 0.33 | P-3 | 0.50 | 0.23 | B-6 $6 \times 10^{-3}$ |
| 11 | I-14 | 0.34 | P-57 | 0.40 | 0.23 | B-6 $6 \times 10^{-3}$ |
| 12 | I-21 | 0.30 | P-57 | 0.40 | 0.18 | B-6 $6 \times 10^{-3}$ |
| 13 | I-14<br>ExC | 0.20<br>0.16 | P-57 | 0.40 | 0.23 | B-6 $6 \times 10^{-3}$ |

In Table 3 above, the numerical values following the compounds denote the coating amounts of the compounds in an unit of $g/m^2$. The solvent used was Solv-4.

Cyan Coupler (ExC):

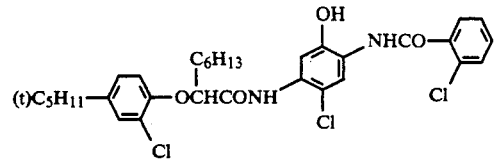

Sample Nos. 8 to 13 were subjected to development processing and tests in the same manner as described in Example 1. The results obtained are shown in Table 4 below.

TABLE 4

| | Color Image Fastness | | | | | | | | | Red-Sensitive Layer | |
|---|---|---|---|---|---|---|---|---|---|---|---|
| | 100° C., 5D | | | 60° C., 70%, 4M | | | Xenon, 14D | | | Relative | Decrease in |
| Sample No. | Y | M | C | Y | M | C | Y | M | C | Sensitivity | Sensitivity |
| 8 (Comparison) | 99 | 96 | 60 | 98 | 98 | 60 | 86 | 79 | 72 | 100 | 72 |
| 9 (Comparison) | 99 | 96 | 80 | 98 | 98 | 85 | 86 | 79 | 70 | 95 | 71 |
| 10 (Present Invention) | 99 | 96 | 90 | 98 | 98 | 92 | 86 | 79 | 81 | 120 | 107 |
| 11 (Present Invention) | 99 | 96 | 92 | 98 | 98 | 95 | 86 | 79 | 84 | 124 | 110 |
| 12 (Present Invention) | 99 | 96 | 92 | 98 | 98 | 95 | 86 | 79 | 85 | 129 | 119 |
| 13 (Present Invention) | 99 | 96 | 93 | 98 | 98 | 96 | 86 | 79 | 84 | 119 | 108 |

Y, M and C denote yellow color image, magenta color image and cyan color image, respectively.

The results shown in Table 4 are equivalent to these obtained in Example 1 and the effects of the present invention are again clearly recognized.

EXAMPLE 3

Sample Nos. 1 to 13 prepared in Examples 1 to 2 were subjected to development processing according to the processing steps illustrated below and tests in the same manner as described in Example 1.

| Processing Step | Temperature | Time |
|---|---|---|
| Color Development | 38° C. | 1 min 40 sec |
| Bleach-Fixing | 30 to 34° C. | 1 min 00 sec |
| Rinse (1) | 30 to 34° C. | 20 sec |
| Rinse (2) | 30 to 34° C. | 20 sec |
| Rinse (3) | 30 to 34° C. | 20 sec |
| Drying | 70 to 80° C. | 50 sec |

Rinse steps were conducted using a three-tank countercurrent system from Rinse (3) to Rinse (1).

The composition of each processing solution used was as follows:

| Color Developing Solution: | |
|---|---|
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Triethylenediamine (1,4-diazobicyclo[2,2,2]octane | 5.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Diethylhydroxyamine | 4.0 g |

-continued

| | |
|---|---|
| Brightening agent (UVITEX-CK manufactured by Ciba-Geigy Co.) | 1.5 g |
| Water to make | 1000 ml |
| pH (25° C.) | 10.25 |
| Bleach-Fixing Solution: | |
| Water | 400 ml |
| Ammonium thiosulfate (70%) | 200 ml |
| Sodium sulfite | 20 g |
| Ammonium ethylenediaminetetraacetato ferrate | 60 g |
| Disodium ethylenediaminetetraacetate | 10 g |
| Water to make | 1000 ml |
| pH (25° C.) | 7.00 |

Rinse Solution

Ion exchanged water (contents of calcium and magnetisum each being not more than 3 ppm).

Equivalent results to those described in Examples 1 and 2 were obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one red-sensitive silver halide emulsion layer, at least one green-sensitive silver halide emulsion layer and at least one blue-sensitive silver halide emulsion layer, where the red-sensitive halide emulsion layer contains a disperson of oleophilic fine particles which is obtained by emulsifying or dispersing a solution containing at least one cyan coupler represented by the general formula (I) and at least one water-insoluble and organic solvent-soluble homopolymer or copolymer composed of at least one recurring unit having no acid group in the main chain or side chain thereof, the green-sensitive silver halide emulsion layer contains at least one magenta coupler represented by the general formula (II) or (III), the blue-sensitive silver halide emulsion layer contains at least one yellow coupler represented by the general formula (IV), and the silver halide color photographic material contains at least one compound represented by the eh general formula (B) incorporated in a red-sensitive silver halide emulsion layer:

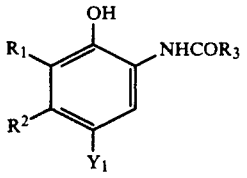

(I)

where $R_1$ represents a hydrogen atom or a halogen atom; $R_2$ represents an alkyl group; $R_3$ represents a ballast group; and $Y_1$ represents a hydrogen atom or a group released at the time of coupling reaction with an oxidation product of a developing agent (hereafter simply referred to as a releasing group),

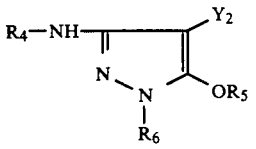

(II)

where $R_4$ represents an aryl group; $R_5$ represents a hydrogen atom, an aliphatic or aromatic acyl group or an aliphatic or aromatic sulfonyl group; $R_6$ represents an aryl group; and $Y_2$ represents a hydrogen atom or a releasing group,

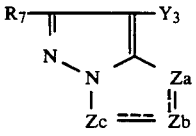

(III)

wherein $R_7$ represents a hydrogen atom or a substitutent; $Y_3$ represents a hydrogen atom or a releasing group; Za, Zb and Zc each represents a methine group, a substituted methine group, =N—or —NH—, one of the Za—Zb bond and the Zb—Zc bond being a double bond and the other being a single bond; when the Zb—Zc bond is a carbon-carbon double bond, the Zb—Zc bond may be a part of a condensed aromatic ring; $R_7$ or $Y_3$ may also form a polymer including a dimer or more; and when Za, Zb or Zc is a substituted methine group, the substituted methine group may form a polymer including a dimert or more,

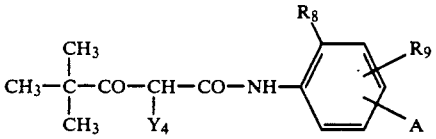

(IV)

where $R_8$ represents a halogen atom or an alkoxy group; $R_8$ represents a hydrogen atom, a halogen atom or an alkoxy group; A represents $—NHCOR_{10}$, $—NHSO_2R_{10}$, $—SO_2NHR_{10}$, $—COOR_{10}$ or

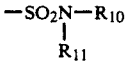

(wherein $R_{10}$ and $R_{11}$ each represents an alkyl group); and $Y_4$ represents a hydrogen atom or a releasing agent,

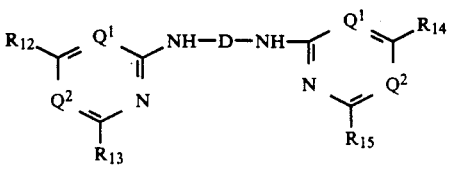

(B)

where D represents a divalent aromatic group represented by the following formula:

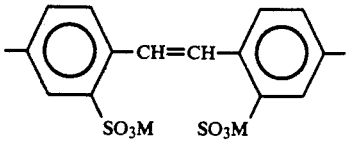

wherein M represents a hydrogen atom or a cation capable of imparting water solubility; $R_{12}$, $R_{13}$, $R_{14}$ and $R_{15}$, which may be the same or different, each represents a hydrogen atom, a hydroxy group, an alkoxy group, an aryloxy group, a halogen atom, a heterocyclic group, a mercapto group, an alkylthio group, an arylthio group, a heterocyclic thio group, an amino group, an alkylamine group, a cyclohexylamino group, an arylamino group, a heterocyclic amino group, an aralkylamino group or an aryl group; and $Q^1$ and $Q^2$ each represents —N= or —CH= and at least one of $Q^1$ and $Q^2$ is —N=.

2. A silver halide color photographic material as claimed in claim 1, wherein the polymer is a polymer composed of a repeating unit having a linkage of

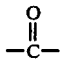

in its main chain or side chain.

3. A silver halide color photographic material as claimed in claim 2, wherein the polymer is a polymer composed of a repeating unit having a linkage of

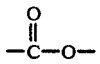

in its main chain or side chain.

4. A silver halide color photographic material as claimed in claim 2, wherein the polymer is composed of a repeating unit having a group of

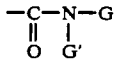

(wherein G and G' each represents a hydrogen atom, an alkyl group or an aryl group) in its side chain.

5. A silver halide color photographic material as claimed in claim 1, wherein the polymer is a vinyl polymer formed from a vinyl monomer or vinyl monomers selected from an acrylic acid ester, a methacrylic acid ester, a vinyl ester, an acrylamide, a methacrylamide, an olefin, a styrene, a vinyl ether and other vinyl monomers having no acid group.

6. A silver halide color photographic material as claimed in claim 5, wherein the polymer is a vinyl polymer further containing a repeating unit derived from a monomer having an acid group selected from acrylic acid, methacrylic acid, itaconic acid, maleic acid, a monoalkyl itaconate, a monoalkyl maleic acid, citraconic acid, styrene sulfonic acid, vinyl benzylsulfonic acid, vinylsulfonic acid, an acryloyloxyalkylsulfonic acid, a methacryloyloxyalkylsulfonic acid, a acrylamidoalkylsulfonic acid, and a methacrylamidoalkylsulfonic acid so long as the polymer obtained is not rendered water-soluble.

7. A silver halide color photographic material as claimed in claim 5, wherein the vinyl monomer is selected from methacrylate monomers, acrylamide monomers and methacrylamide monomers.

8. A silver halide color photographic material as claimed in claim 5, wherein the polymer is a copolymer of acrylamide monomers and (an)other monomer(s) and a copolymer of methacrylate monomers and (an)other monomer(s).

9. A silver halide color photographic material as claimed in claim 1, wherein the polymer is a polyester resin obtained by condensation of a polyvalent alcohol and polybasic acid.

10. A silver halide color photographic material as claimed in claim 9, wherein the polyvalent alcohol is a glycol having the structure HO—$R_1$, —OH (wherein $R_1$, represents a hydrocarbon chain having from 2 to about 12 carbon atoms) or a polyalkylene glycol.

11. A silver halide color photographic material as claimed in claim 9, wherein the polybasic acid is represented by the formula HOOC—$R_2$, —COOH (wherein $R_2$, represents a single bond or a hydrocarbon chain having from 1 to about 12 carbon atoms).

12. A silver halide color photographic material as claimed in claim 1, wherein the polymer is a polyester obtained by open ring condensation of a monomer represented by the following formula:

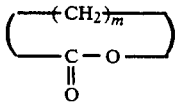

wherein m represents an integer from 4 to 7 and the —$CH_2$—chain may be a branched chain.

13. A silver halide color photographic material as claimed in claim 1, wherein the viscosity of the polymer is not more than 5,000 cps when 30 g of the polymer is dissolved in 100 ml of an auxiliary solvent.

14. A silver halide color photographic material as claimed in claim 1, wherein the weight average molecular weight of the polymer is not more than 150,000.

15. A silver halide color photographic material as claimed in claim 1, wherein the releasing group represented by $Y_1$, $Y_2$, $Y_3$ or $Y_4$ is a group capable of connecting a coupling-active carbon atom to an aliphatic group, an aromatic group, a heterocyclic group, an aliphatic, aromatic, or heterocyclic sulfonyl group, or an aliphatic, aromatic, or heterocyclic carbonyl group via an oxygen atom, a nitrogen atom, a sulfur atom, or a carbon atom; a halogen atom; or an aromatic azo group.

16. A silver halide color photographic material as claimed in claim 15, wherein the releasing group is selected from a halogen atom, an alkoxy group, an aryloxy group, an acyloxy group, an aliphatic or aromatic sulfonyloxy group, an acylamino group, an aliphatic or aromatic sulfonamido group, an alkoxycarbonyloxy group, an aryloxycarbonyloxy group, an aliphatic, aromatic or heterocyclic thio group, a carbamoylamino group, a 5-membered or 6-membered nitrogencontaining heterocyclic group, an imido group, and an aromatic azo group.

17. A silver halide color photographic material as claimed in claim 1, wherein $R_1$ represents a halogen atom; $R_2$ represents an alkyl group having from 2 to 15 carbon atoms or a methyl group having a substituent having 1 or more carbon atoms selected from an arylthio group, an alkylthio group, an acylamino group, an aryloxy group and an alkoxy group; $R_3$ represents a substituted or unsubstituted alkyl or aryl group; and $Y_1$ represents a hydrogen atom, a halogen atom, an alkoxy group, an aryloxy group, an acyloxy group or a sulfonamido group.

18. A silver halide color photographic material as claimed in claim 1, wherein $R_5$ represents a hydrogen atom, an aliphatic acyl group or an aliphatic sulfonyl group; $R_4$ and $R_6$ each represents a phenyl group; and $Y_2$ represents a group capable of being released at a sulfur atom, an oxygen atom or a nitrogen atom.

19. A silver halide color photographic material as claimed in claim 1, wherein the magenta coupler represented by the general formula (III) is a 1H-imidazopyrazole, a 1H-pyrazolopyrazole, a 1H-pyrazolo-triazole, a 1H-pyrazolotriazole or a 1H-pyrazolotetrazole.

20. A silver halide color photographic material as claimed in claim 1, wherein the magenta coupler is represented by the following general formula (V), (VI), (VII), (VIII) or (IX):

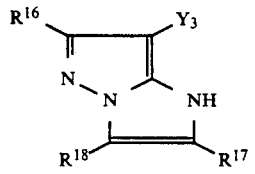

(V)

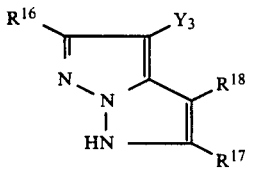

(VI)

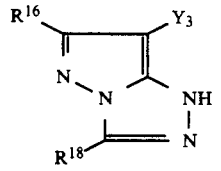

(VII)

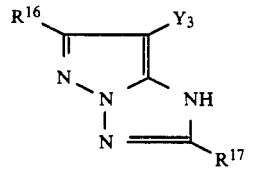

(VIII)

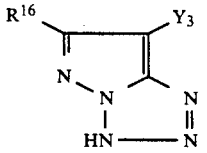

(IX)

wherein $R^{16}$, $R^{17}$ and $R^{18}$ each represents an aliphatic group, an aromatic group, a heterocyclic group,

RO—, RC(=O)—, RCO(=O)—, RSO—, $RSO_2$—, $RSO_2NH$—,

RC(=O)NH—, RNH—, RS—, ROC(=O)NH—

(wherein R represents an alkyl group, an aryl group or a heterocyclic group), a hydrogen atom, a halogen atom, a cyano group, an imido group, a carbamoyl group, a sulfamoyl group, a ureido group or a sulfamoylamino groupl $Y_3$ has the same meaning as defined above, or $R^{16}$, $R^{17}$, $R^{18}$ or $Y_3$ may be a divalent group to form a dimer or may be a divalent group for linking the coupler moiety to a polymer chain.

21. A silver halide color photographic material as claimed in claim 20, wherein $R^{16}$, $R^{17}$ and $R^{18}$ each represents a hydrogen atom, a halogen atom, an aliphatic group, an aromatic group, a heterocyclic group, RO—, RCONH—, $RSO_2NH$—, RS— or ROCONH—, $Y_3$ preferably represents a halogen atom, an acylamino group, an imido group, an aliphatic or aromatic sulfonamido group, a 5-membered or 6-membered nitrogen-containing heterocyclic group connecting to the coupling active position at the nitrogen atom, an aryloxy group, an alkoxy group, an arylthio group or an alkylthio group.

22. A silver halide color photographic material as claimed in claim 1, wherein the releasing group represented by $Y_4$ is a group represented by the following general formula (X), (XI), (XII) or (XIII):

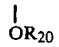

(X)

wherein $R_{20}$ represents an aryl group which may be substituted or a heterocyclic group which may be substituted,

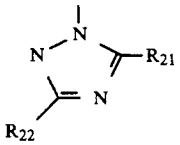

(XI)

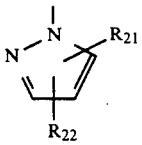

(XII)

wherein $R_{21}$ and $R_{22}$, which may be the same or different, each represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, an unsubstituted or substituted phenyl group or an unsubstituted or substituted heterocyclic group, (XIII)

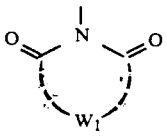

wherein $W_1$ represents the non-metallic atoms necessary for forming a 4-membered, 5-membered or 6-membered ring together with

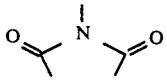

in the formula.

23. A silver halide color photographic material as claimed in claim 22, wherein the group represented by the general formula (XIII) is a group represented by one of the following general formulae (XIV) to (XVI):

(XIV)

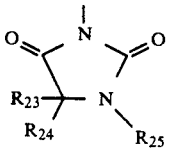

-continued (XV)

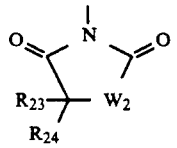

(XVI)

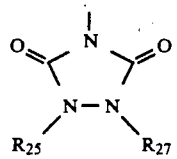

wherein $R_{23}$ and $R_{24}$ each represents a hydrogen atom, an alkyl group, an aryl group, an alkoxy group, an aryloxy group or a hydroxyl group; $R_{25}$, $R_{26}$ and $R_{27}$ each represents a hydrogen atom, an alkyl group, an aryl group, an aralkyl group or an acyl group; and $W_2$ represents an oxygen atom or a sulfur atom.

24. A silver halide color photographic material as claimed in claim 1, wherein at least one or $R_{12}$, $R_{13}$, $R_{14}$ and $R_{15}$ is an aryloxy group, a heterocyclic thio group or a heterocyclic amino group.

25. A sliver halide color photographic material as claimed in claim 1, wherein the magenta coupler and the yellow coupler are each present together with an organic solvent having a boiling point of 160° C. or above, a dielectric constant of 2 to 20 (at 25° C.) and a refractive index of 1.3 to 1.7 (at 25° C.).

26. A silver halide color photographic material as claimed in claim 1, wherein the layer containing the coupler represented by the general formula (I) or a layer adjacent thereto contains an ultraviolet light absorbing agent represented by the following general formula (XVII):

(XVII)

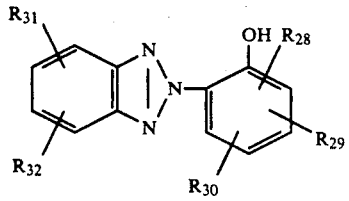

wherein $R_{28}$, $R_{29}$, $R_{30}$, $R_{31}$ and $R_{32}$, which may be the same or different, each represents a hydrogen atom, a halogen atom, a nitro group, a hydroxy group, an alkyl group, an alkenyl group, an aryl group, an alkoxy group, an acyloxy group, an aryloxy group, an alkylthio group, an arylthio group, a mono- or di-alkylamino group, an acylamino group or a 5-membered or 6-membered heterocyclic group containing an oxygen atom or a nitrogen atom, or $R_{31}$ and $R_{32}$ may be connected each other to form a 5-membered or 6-membered aromatic ring comprising carbon atoms.

* * * * *